United States Patent [19]

Peterman et al.

[11] Patent Number: 5,020,304

[45] Date of Patent: Jun. 4, 1991

[54] METHOD AND APPARATUS FOR LOADING AND STACKING CRATES

[75] Inventors: Thomas H. Peterman, Farwell; David L. Anderson, Alexandria, both of Minn.; Jan Hakansson, Eslöv, Sweden; Harijs B. Marovskis, Plymouth, Minn.

[73] Assignee: Tetra Pak Holdings & Finance S.A., Pully, Switzerland

[21] Appl. No.: 433,369

[22] Filed: Nov. 8, 1989

[51] Int. Cl.[5] ..... B65B 13/02; B65B 43/00

[52] U.S. Cl. ..... 53/458; 53/564; 53/589

[58] Field of Search ..... 53/458, 399, 564, 566, 53/589, 590, 457, 452

[56] References Cited

U.S. PATENT DOCUMENTS

| | | | |
|---|---|---|---|
| 2,624,990 | 1/1953 | Allen | 53/589 X |
| 2,947,125 | 8/1960 | Wilson et al. | 53/589 X |
| 3,541,760 | 11/1970 | Hickin | 53/564 |
| 3,626,661 | 12/1971 | Reichert et al. | 53/564 X |
| 3,951,049 | 4/1976 | Brackmann et al. | 53/589 X |
| 4,785,610 | 11/1988 | Valenti | 53/564 X |

*Primary Examiner*—James F. Coan

*Attorney, Agent, or Firm*—Burns, Doane, Swecker & Mathis

[57] ABSTRACT

A machine for loading articles such as milk cartons in a crate and stacking the crates for transport is described. The crate has folding sides. A supply of crates stacked in folded condition is introduced into the machine. The crates are removed individually from the stack by the machine, the sides are raised, and the crates are arranged vertically on a conveyor in preparation to receive the filled cartons. Cartons are inserted into a crate, which is then banded by a plastic strip, and the crate is placed in a stack with other crates that have been filled with cartons. The stack of filled crates is then unloaded from the machine.

72 Claims, 22 Drawing Sheets

Fig. 17
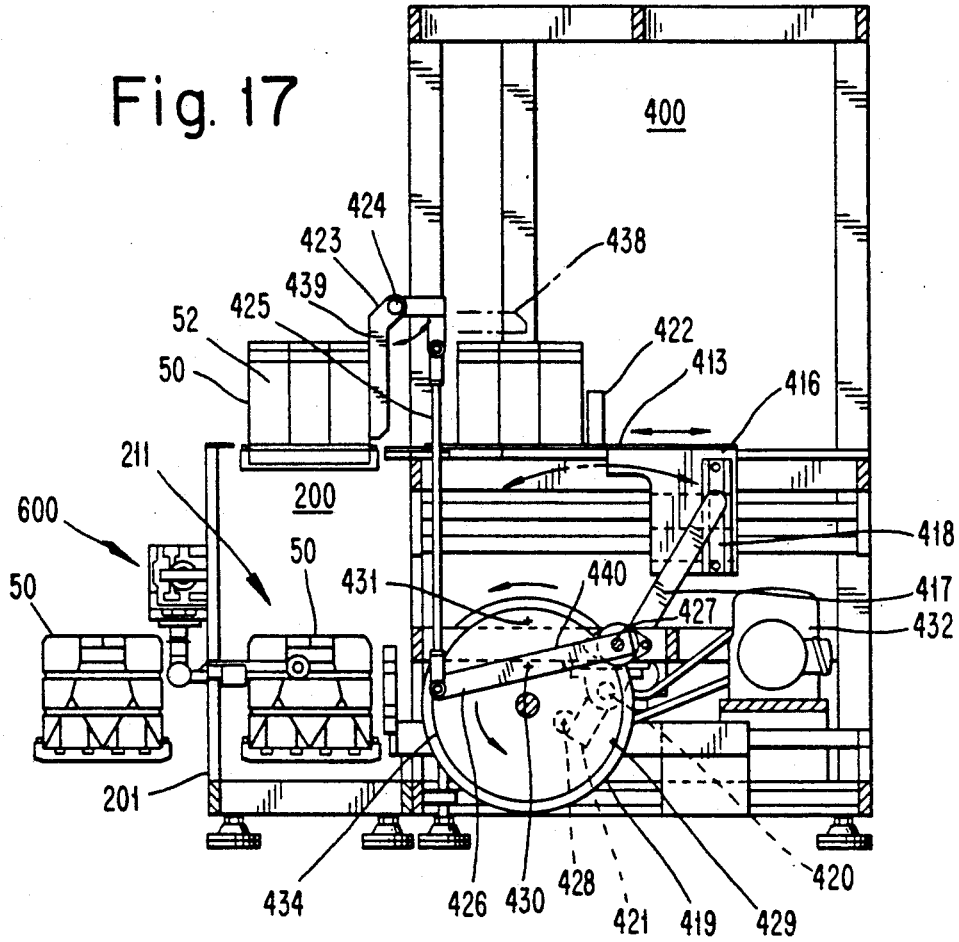
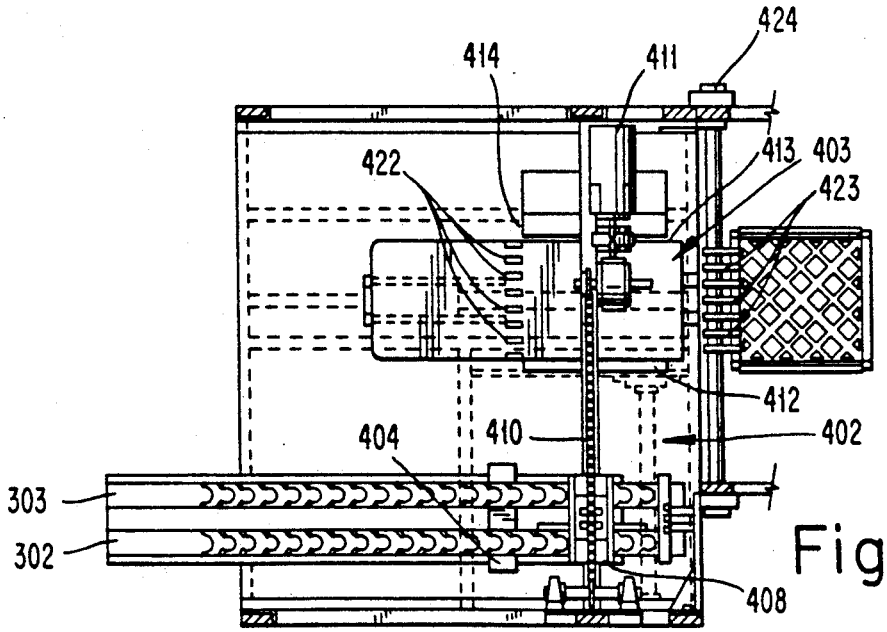
Fig. 18

METHOD AND APPARATUS FOR LOADING AND STACKING CRATES

FIELD OF THE INVENTION

The present invention generally relates to a machine for loading crates. More particularly, the present invention relates to a machine for unfolding a crate, loading the unfolded crate with packages and positioning the loaded crates into a stack.

BACKGROUND OF THE INVENTION

In the transport and handling of packages such as milk cartons and other beverage containers, packing crates manufactured as one-piece units with four rigid walls are typically used. The use of such crates encounters a number of drawbacks, however, since such a rigid construction prevents the crates from being reduced in size (i.e. folded).

For example, until the rigid crates are needed for receiving packages, the crates must be stored within the packaging facility. The irreducible size of the crates requires an unduly large storage area within the facility that hampers the cost effective use of space by the facility operator.

Additionally, the machines used for packing the rigidly constructed crates tend to be unnecessarily large since each area within the packing machine must accommodate the full size and construction of the rigid crate. The operating mechanisms within such machines also tend to be unnecessarily slow since each operation involves manipulating the entire crate as a whole. Yet still further, the machine-handling of the packages that are loaded into each crate tends to be rough and inaccurate since the packages usually are simply dropped by gravity into the single open end of the crate. Each of these drawbacks leads to uneconomical packing operations that unduly add to the manufacturing costs of producing packaged materials.

In response to at least the aforesaid drawbacks in using a rigidly constructed packing crate, it has been proposed to provide a foldable crate such as disclosed in U.S. patent application No. 07/369,848. Through the use of such a foldable crate, significant economic savings may be realized in reducing the amount of storage space needed within packing facilities because each foldable crate may be reduced in sized and stacked upon one another for storage. However, the space saving advantages of such a foldable crate are not practical without a rapid method for erecting the complete crate and filling it with cartons.

OBJECTS OF THE INVENTION

An object of the present invention is to provide an apparatus for loading crates that solves the above-mentioned problems.

It is a further object of the present invention to provide an apparatus for loading and stacking crates that is economical in size and operation.

It is another object of the present invention to provide an apparatus for loading and stacking crates that manipulates the crates efficiently.

It is another object of the present invention to provide an apparatus that accurately and gently loads packages into a crate.

These objects are accomplished by a machine for loading crates that includes a device for orienting a crate from a folded to an unfolded configuration, a device or loading and unfolded crate with packages and a device for transporting the unfolded crate from the device for orienting the crate to the device for loading the crate. The machine also includes a device for feeding the packages to device for loading. Yet further, the device may include a device for stacking the crates. orienting each of two foldable sides of a folded crate into an upright position;

These objects are also accomplished by a method of loading crates that include the steps of first, orienting each of two foldable sides of a crate into an upright position; lowering the crate to a loading position; orienting each of two foldable sides into an upright position; inserting a predetermined number of packages between the upright sides of the crate; banding the crate to secure the packages within the crate; and positioning the crate beneath a previously loaded crate to form a stack of loaded crates of a predetermined height.

DESCRIPTION OF THE DRAWINGS

A preferred embodiment of the present invention is shown in the accompanying drawings wherein:

FIG. 17 is a rear elevational view of the cross-pusher/loader of FIG. 16;

FIG. 18 is a top view of the cross-pusher/loader of FIG. 15;

DETAILED DESCRIPTION

Figure 24:
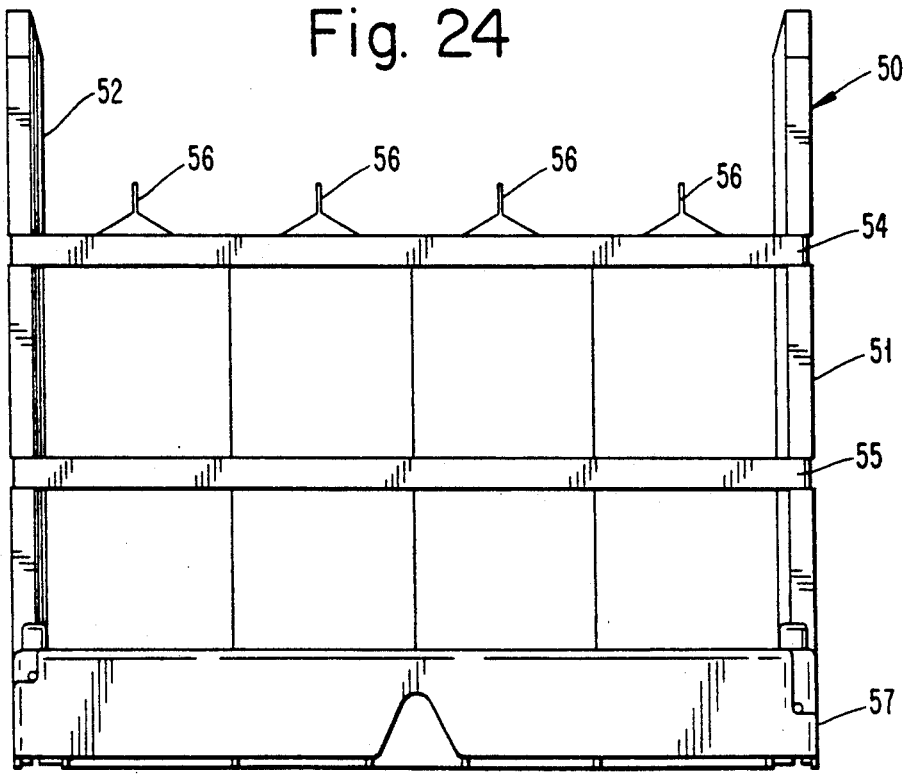
FIG. 24 is a front view of the crate of FIG. 23.
Figure 25:
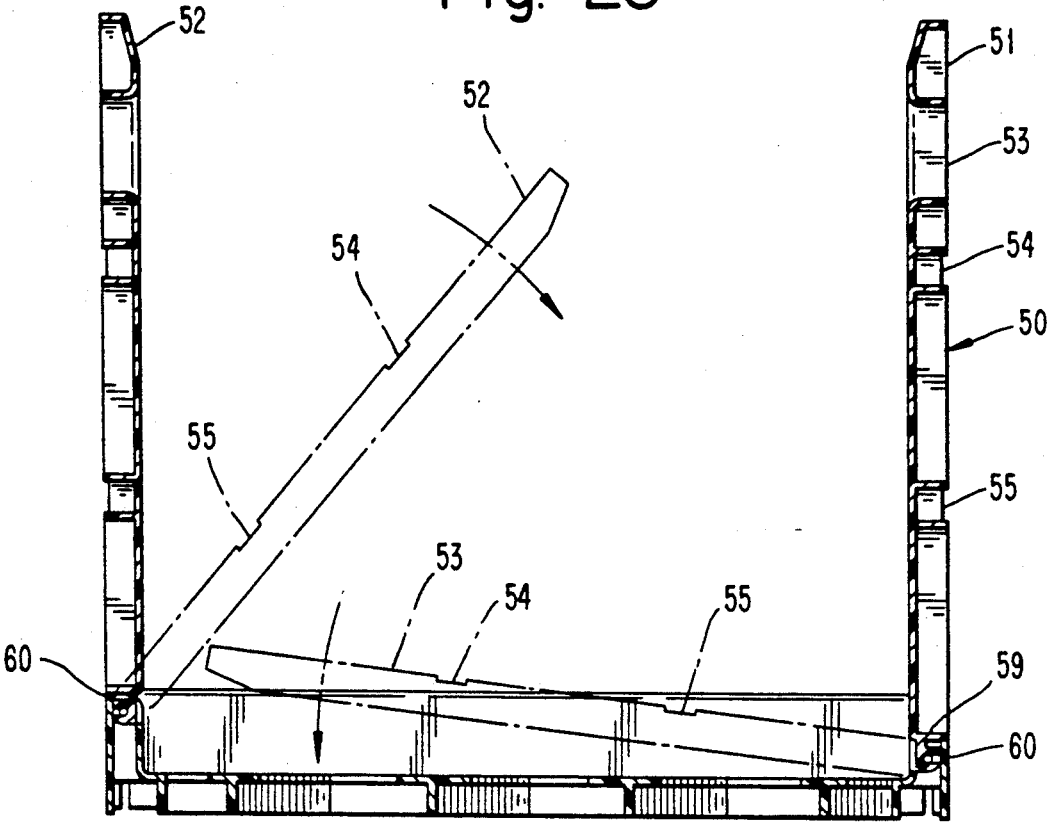
FIG. 25 is a cross-sectional view of the crate of FIG. 24.
Figure 26:
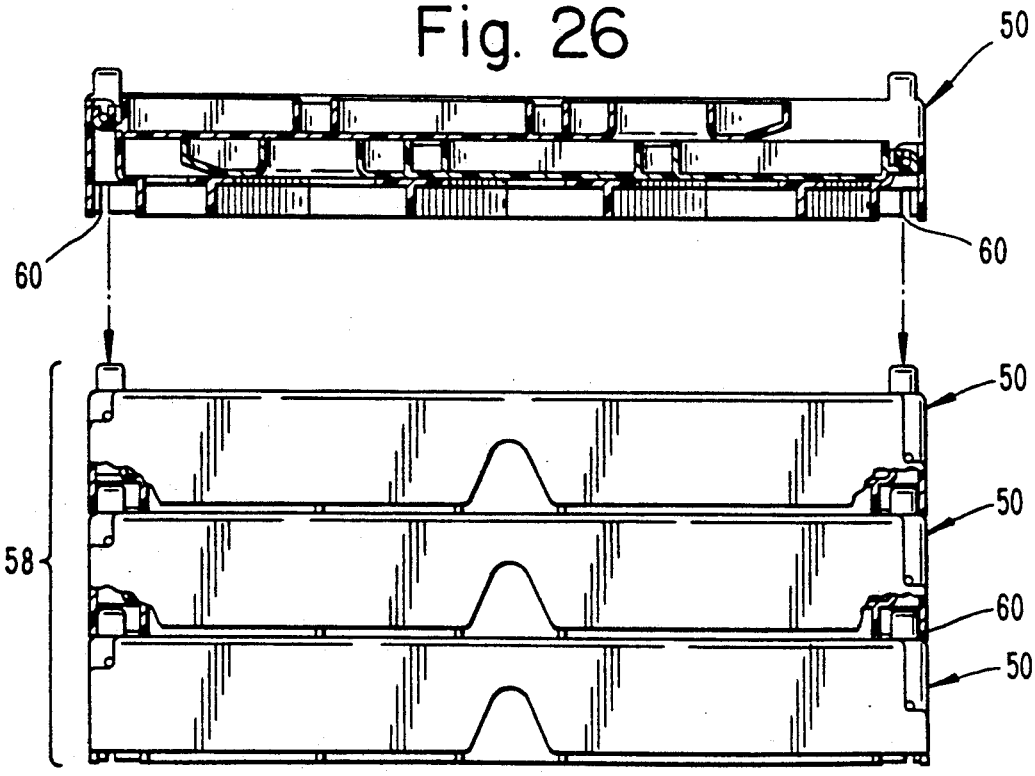
FIG. 26 is a stack of folded crates used in the apparatus of FIG. 1.

A preferred embodiment of the present invention is generally depicted in FIGS. 1–4 wherein a packing machine is shown which repeatedly and sequentially unfolds, loads and stacks crates 50, one of which is generally depicted in FIGS. 23–26. In particular, the packing machine first separates a folded crate 50 from a stack of folded crates such as the stack shown in FIG. 26 and then manipulates that crate 50 into the unfolded condition shown in FIG. 25. The packing machine then loads the unfolded crate 50 with containers such as cartons 56 to provide a loaded crate as shown in FIG. 24. Finally, the packing machine positions a series of loaded crates on top of one another to form a stack of crates as depicted in phantom lines in FIG. 1. The structure of a suitable crate is disclosed in U.S. patent application Ser. No. 07/369,848, filed June 22, 1989, which is incorporated herein as if fully set forth.

The packing machine as shown in FIGS. 1–4 generally includes an unfolder 100, a lowerator 200, an infeed 300, a cross-pusher/loader 400 and a stacker 500. Beginning at the unfolder 100, the packing machine sequentially unfold either each crate 50 of a stack of folded crates that has been placed on the unfolder either by a machine operator or a mechanical loader (not shown). After a crate is unfolded, it is transported by the unfolder to the lowerator 200 which sequentially lowers each unfolded crate to a level adjacent the cross-pusher/loader 400.

During unfolding and lowering of the crates 50, containers such as cartons are being fed to the cross-pusher/loader in an ordered and sequential fashion by an infeed 300. When a desired number of containers have been properly transported to the cross-pusher/-loader by the infeed 300 and an unfolded crate 50 has been lowered by the lowerator 200 to an appropriate height, the cross-pusher/loader serves to transport the desired number of containers into the crate 50. The loaded crate is then further lowered by the lowerator 200 to a position where the containers are secured within the crate by a polypropylene strip which is attached by a bander 600. The loaded and banded crate is then transported to the stacker 500 which serves to sequentially position each loaded and banded crate on top of one another to form a stack. The stack of loaded crates is then transported to an exiting stage of the stacker 500. The unfolder 100, lowerator 200, infeed 300, cross-pusher/loader 400 and stacker 500 are more specifically discussed below.

Unfolder

The unfolder is depicted in FIGS. 5, 5A–5D and 6 and includes a conveyor platform 101 having an unstacking area 105, an unfolding area 106 and a holding area 107. The conveyor platform 101 has two conveyor tracks 102A, 102B located on each of the outer edges of the platform 101 which serve to transport the crates 50 to the right. Each of the conveyor tracks 102A, 102B mesh with various sprockets 104 which, in turn, are driven by motor 103 by a chain (not shown). Since both of the conveyor tracks 102A, 102B are driven by the same motor 103, the tracks travel at substantially the same rate of speed.

At the unstacking area 105 of the unfolder, a stack of folded crates 58 are positioned either by a machine operator or mechanical loader (not shown) in a location on the conveyor platform 101 bounded by two guard rails 108A, 108B. Guard rail 108A is fixed in a stationary manner on one side of the platform 101 while guard rail 108B is movable by an actuator 109 in a direction transverse to the conveying direction of the tracks 102A, 102B. When the stack of folded crates 58 is properly positioned between the guard rails 108A, 108B on the conveyor platform 101, guard rail 108B is actuated inwardly by the actuator 109 such that the stack of folded crates 58 is securely held between the guard rails 108A, 108B. The stack 58 is thus prevented from being moved by the conveyor tracks 102A, 102B.

Figure 1:
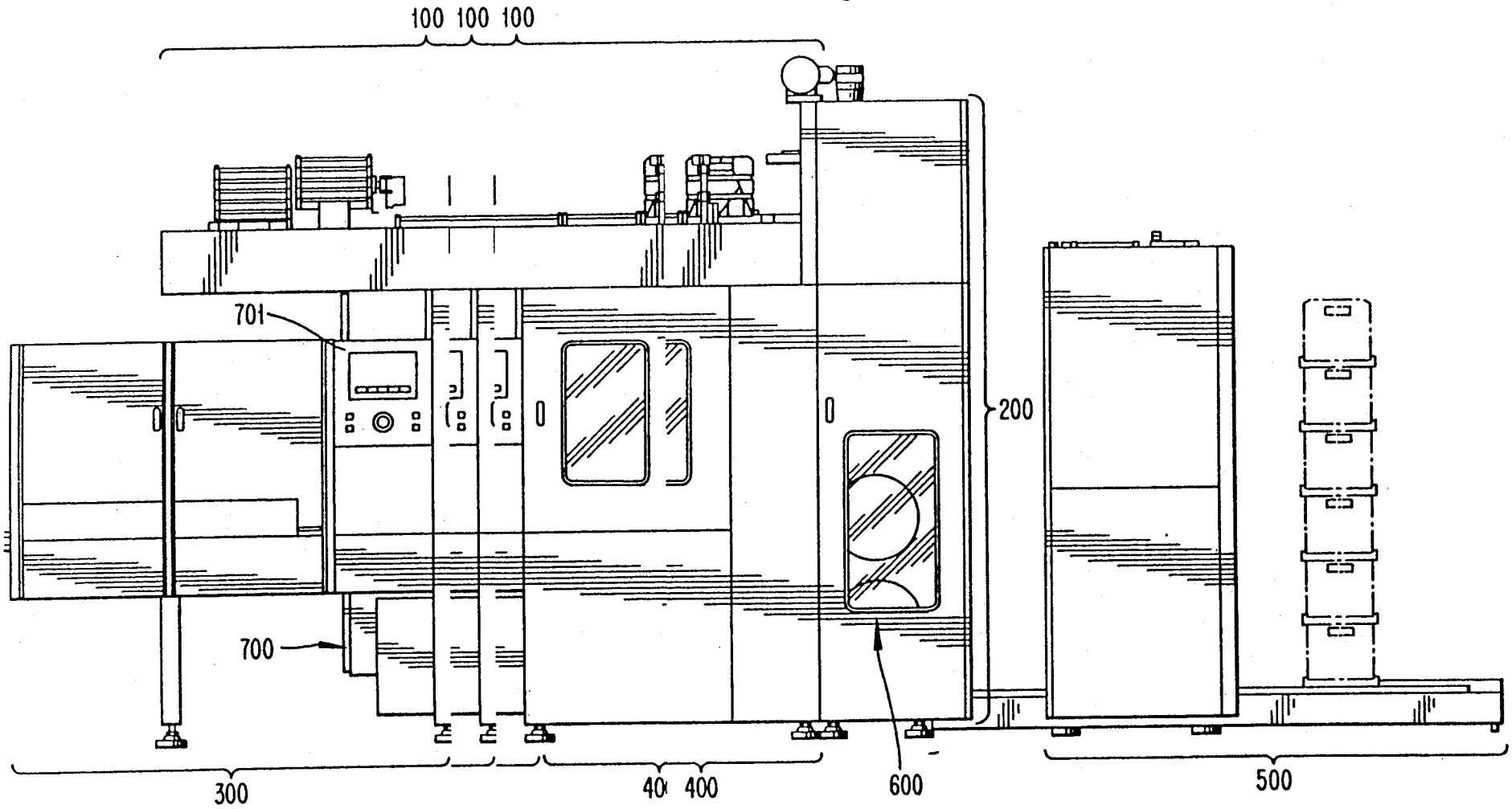
FIG. 1 is a front elevational view of the apparatus for loading and stacking crates in accordance with the present invention.
Figure 2:
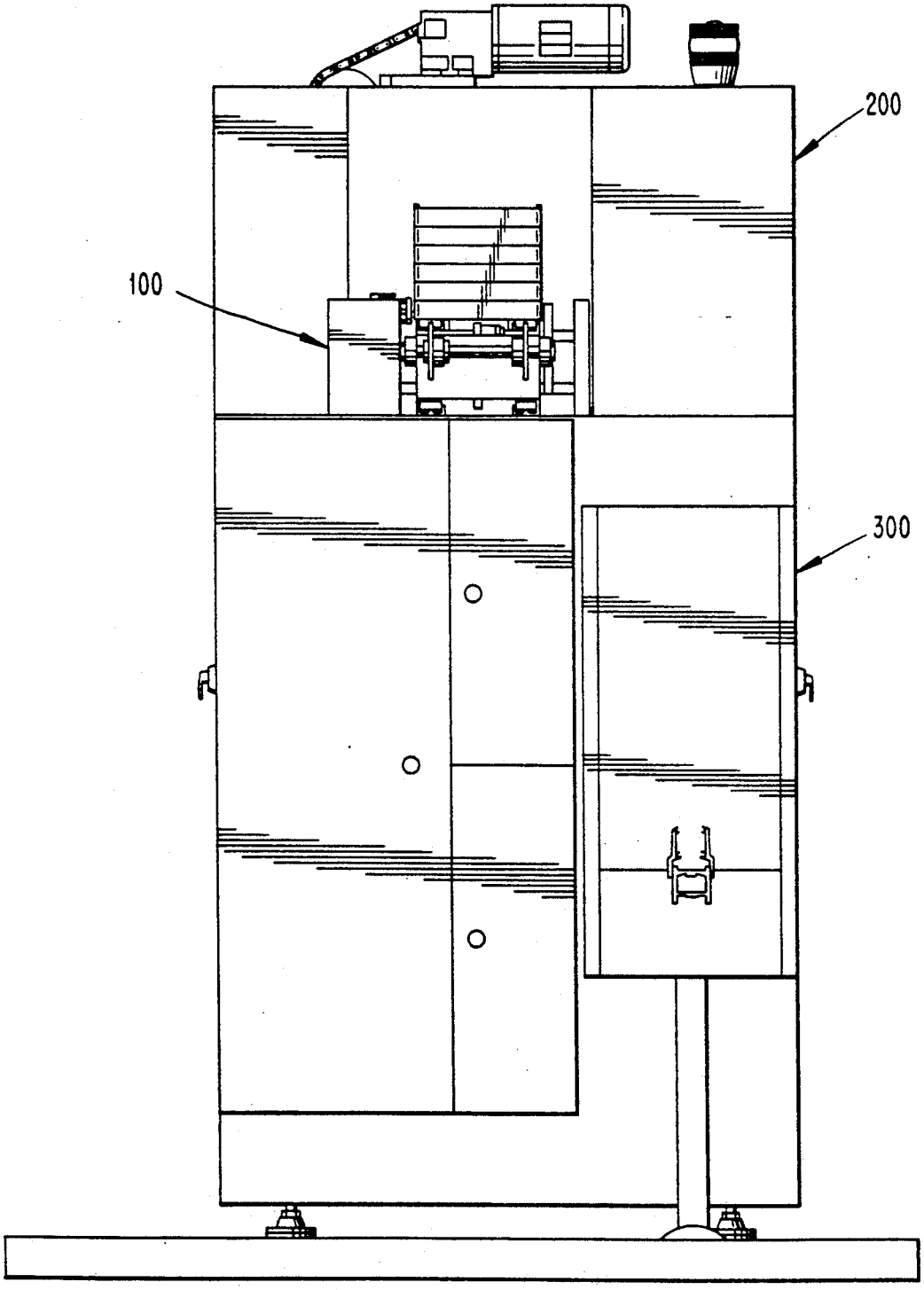
FIG. 2 is a side elevational view of the apparatus of FIG. 1 as viewed from the left side of FIG. 1.
Figure 3:
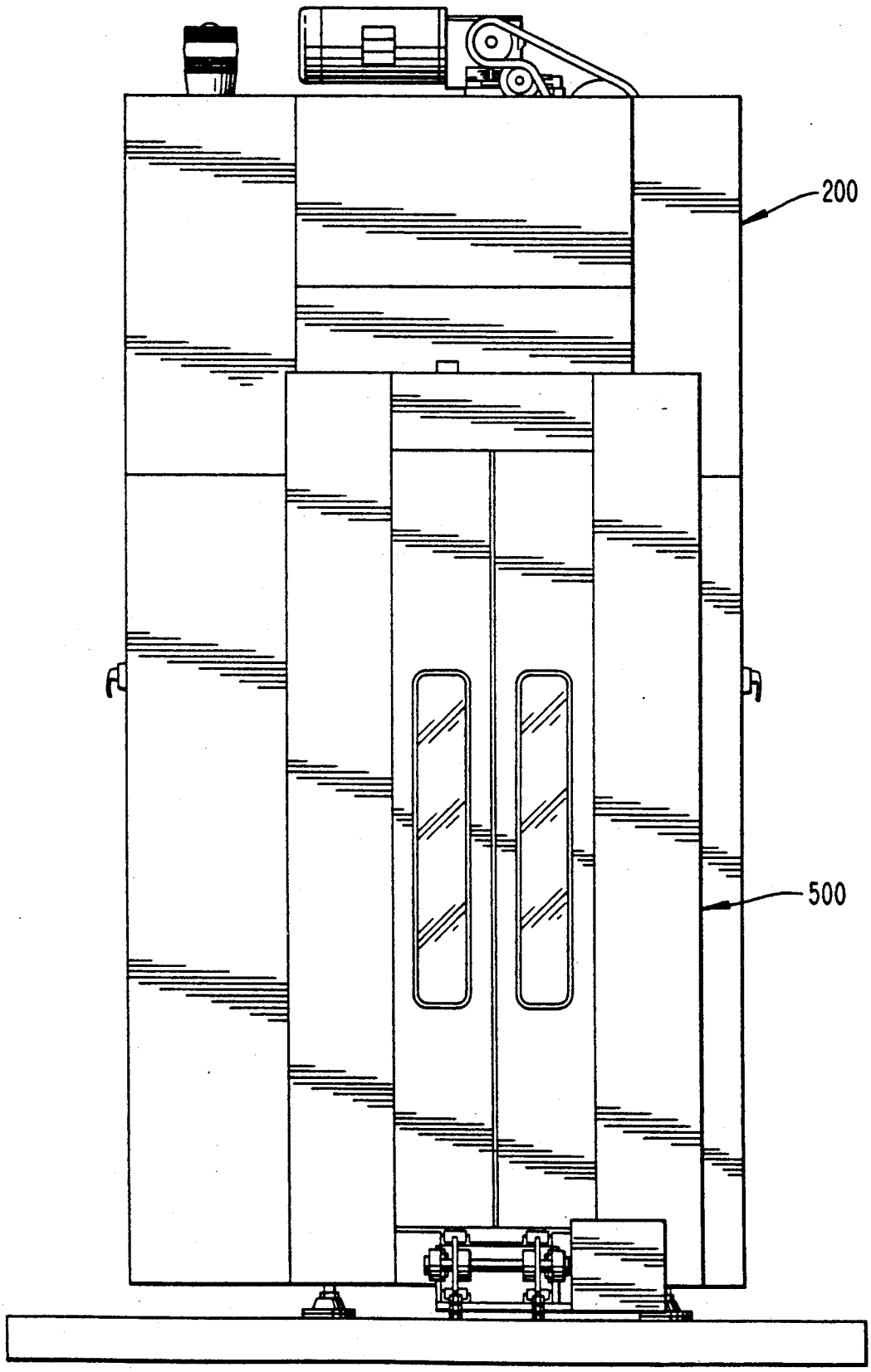
FIG. 3 is a side elevational view of the apparatus of FIG. 1 as viewed from the right side of FIG. 1.
Figure 4:
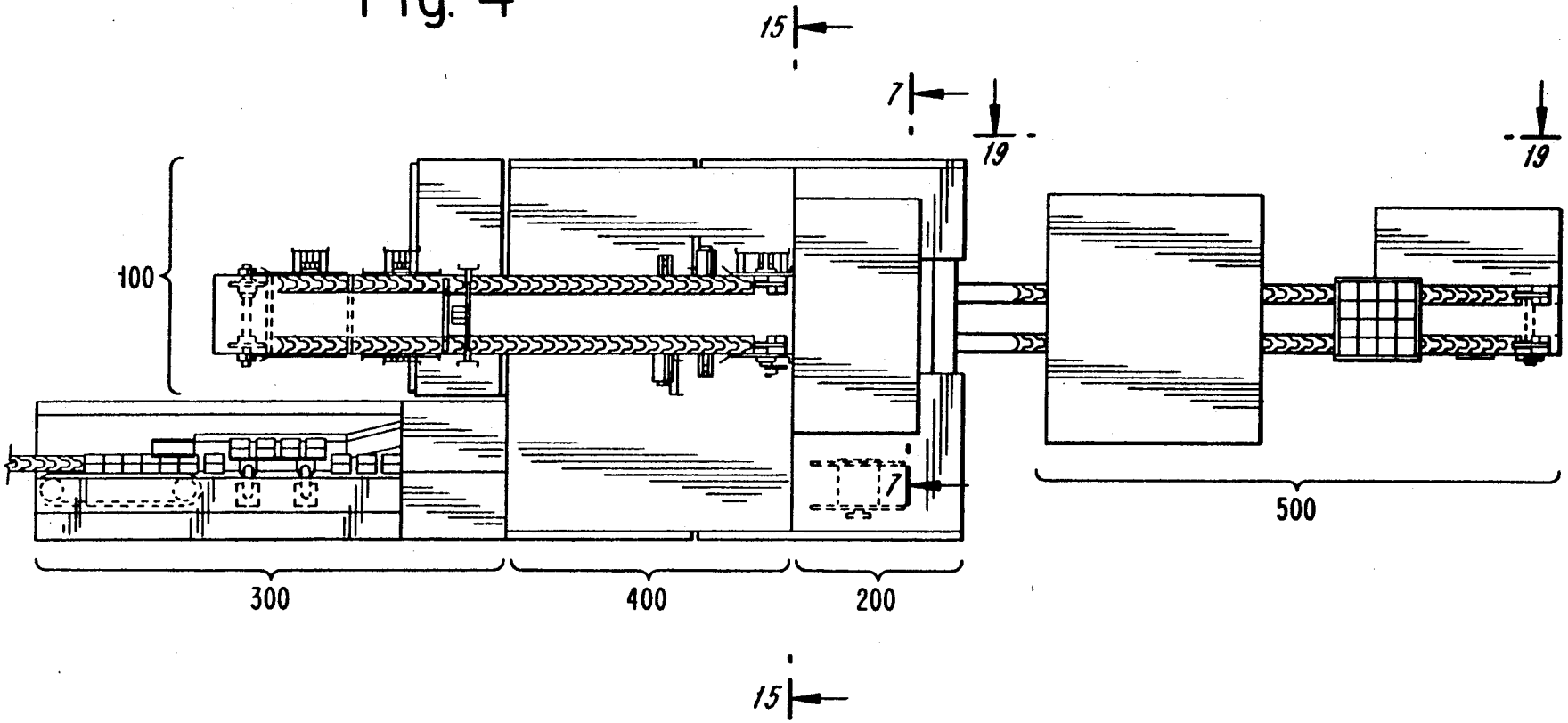
FIG. 4 is a top view of the apparatus of FIG. 1.
Figure 5:
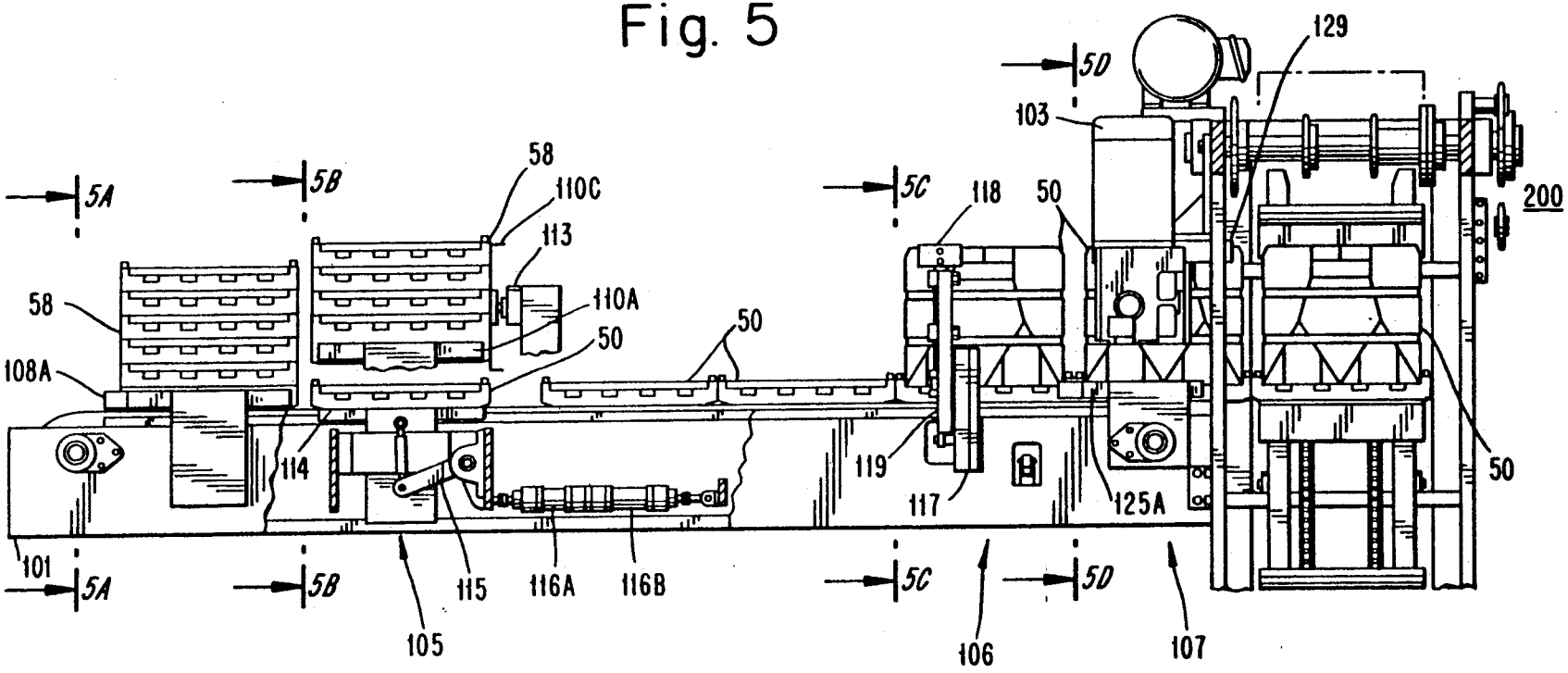
FIG. 5 is a side elevational view, partially in cross-section of the unfolder of the apparatus of FIG. 1.
Figure 5A:
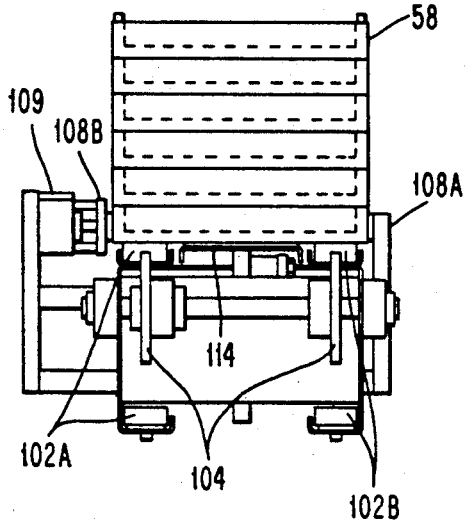
FIGS. 5A–5D are cross-sectional views of the unfolder of FIG. 5 along the lines 5A to 5D, respectively in FIG. 5.
Figure 5B:
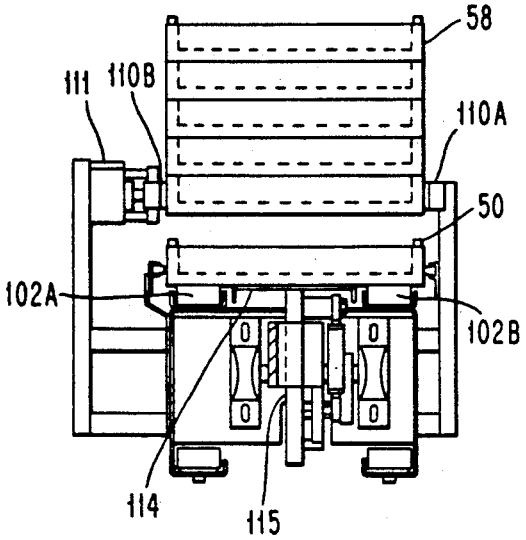

When movement of the stack 58 in the conveying direction is desired, the actuator 109 is released and the guard rail 108B is moved outwardly. The release of the guard rail 108B allows the conveyor tracks 102A, 102B to transport the stack 58 to an area bounded by the guard rails 110A, 110B and 110C. The release of the guard rail 108B also allows an additional stack 58 to be transported to the area just vacated by the original stack 58. When the additional stack is located between the guard rails 108A and 108B, guard rail 108B is once again actuated inwardly to prevent further movement by the additional stack. As shown in FIGS. 5 and 5B, the guard rails 110A, 110B and 110C are positioned at a vertical height relative to the stack 58 such that a space between the guard rails and the conveyor tracks 102A, 102B provides sufficient clearance for the positioning of a single unfolded crate 50. The guard rail 110A is fixed in a stationary manner to the conveyor platform 101 while the guard rail 110B is movable by an actuator 111 in a direction transverse to the conveying direction of the tracks 102A, 102B. Guard rail 110C is movable back and forth by an actuator 113 in a direction along the conveying direction of the tracks 102A, 102B.

Prior to moving the stack 58 to the area bounded by guard rails 110A, 110B and 110C, guard rail 110 C is urged in a direction opposite the conveying direction. The stack 58 then moves into contact with the guard rail 110C until guard rail 108B is actuated to prevent further movement of the additional stack located upstream of the moving stack. Guard rail 110C is then urged to return to a home position in the conveying direction thus creating a space between the moving stack and the additional stack 58 now positioned between guard rails 108A and 108B.

Following creating of a space between the two stacks, the actuator 111 is activated to move the guard rail 110B so as to compress and hold the stack 58 stationary relative to the movement of the conveyor tracks 102A, 102B. A platform 115, which is normally positioned below conveyor tracks 102A, 102B, is then urged in an upward direction by an actuator 116A and accompanying linkage 115 until the platform 114 is in contact with the bottom of the lowermost crate of the stack 58. The guard rail 110B is then released from compressing the stack so that the stack 58 may be urged in an upward manner by further vertical movement of the platform 114.

After upward movement of the stack 58 to a desired height, the guard rail is again actuated to compress the stack 58 against the stationary guard rail 110A. The platform 114 is then lowered to its original position the conveyor tracks 102A, 102B. However, since the guard rails 110A, 110B and 110C are located at a height providing a clearance for a single unfolded crate to be further conveyed along the platform 101, the lowermost crate 50 of the stack 58 will be lowered along with the platform until the lowermost crate 50 comes in contact with the conveyor tracks 102A, 102B. Upon contacting the conveyor tracks 102A, 102B, the lowermost crate 50 will then be transported toward the unfolding area 106.

When it is desired to remove another unfolded crate 50 from the stack 58, the platform 114 is raised by an actuator 116B so as to come into contact with the next lowermost crate of the stack 58. The guard rail 110B is released and the platform 114 is returned to its home position below the tracks. The actuator 116A is then actuated to lift the platform until the next lowermost crate 50 is within the clearance between the conveyor tracks 102A, 102B and the guard rails 110A, 110B and 110C. The guard rail 110B is then again urged inwardly to compress the remaining portion of the stack 58 against the stationary guard rail 110A. The actuator 116A is then released and platform 114 returns to the home position below the conveyor tracks 102A, 102B and the next lowermost crate is urged toward the unfolding area 106. The raising and lowering operation of the platform 114 continues until each unfolded crate of the stack 58 is individually transported to the unfolding area 106. The light sensing device detects when the last crate has been transported to the unfolding area (unshown) and then allows the additional stack 58 to be transported to the platform area. This operation is repeated for as many stacks as are loaded onto the unfolder 100.

Figure 5C:
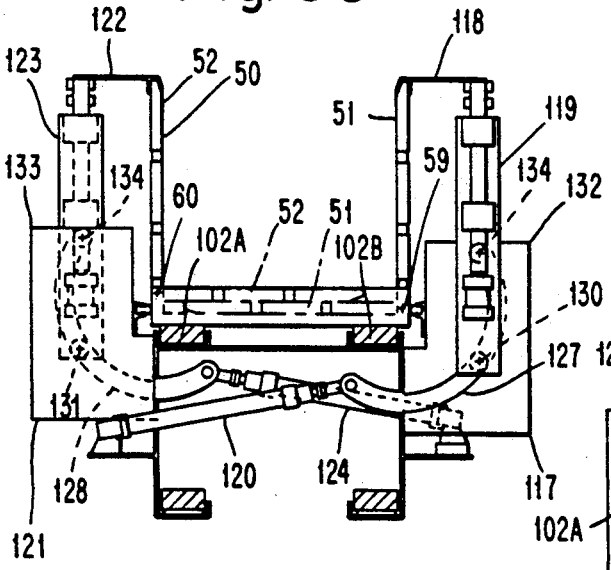

In the unfolding area 106, each of the folded crates 50 are sequentially stopped so that unfolding mechanisms 117, 121 may lift the foldable sides 51, 52 of the crate 50 into an upright position as shown in FIG. 5C. The unfolding mechanism 121 includes an actuator 124 that is attached to an arcuate segment 128 which slides in an arcuate track (not shown) of a block 133. The arcuate segment 128 is attached to an actuator 123 at points 131 and 134. At one end of the actuator 123, is attached a gripping bracket 122.

When the actuator 124 is extended, the arcuate segment 128 is caused to slide in the arcuate slot of the block 133 thus rotating the actuator 124 into a horizontal position. Prior to the actuation of actuator 124, however, the actuator 123 has been actuated so as to extend the gripping bracket 122. Following the rotating of the actuator 123 into a horizontal position, the actuator 123 is again energized so as to draw the gripping bracket 122 into engagement with the top edge of side 52 of the crate 50. The actuator 124 is then retracted and urges the arcuate section 127 to travel back through the arcuate groove of the block 132 and thus return actuator 123 to a vertical position. Since the side 52 of the crate 50 has been engaged by the gripping bracket 122, the return of the actuator 123 to the vertical position will also move the side 51 of the crate 50 to an upright position.

An identical operation is performed for the opposite side 51 of the crate 50 by the unfolding mechanism 117. An actuator 120 is attached to an arcuate portion 127 that slides in a arcuate groove (not shown) of a block 132. The arcuate portion 127 is attached to an actuator 119 at points 134 and 130. At one end of the actuator 119 is a gripping bracket 118 that is used for engaging the top edge of the side 51 of the crate 50.

Each of the unfolding mechanisms 127, 121 utilizes an arcuate portion 127, 128 travelling in an arcuate slot of blocks 132, 133. Such configuration provides a pivot point for each mechanism that coincides with the pivot point of the side 51, 52 of the crate 50 which each respective mechanism moves into an upright position. That is, through the utilization of an arcuate segment 127, the unfolding mechanism 117 has a pivoting point that coincides with the pivot point 59 of the side 51 of crate 50. Similarly, through the utilization of the arcuate portion 128, the unfolding mechanism 121 has a pivoting point that coincides with pivot point 60 of the side 52 of crate 50. Due to the use of such a configuration it is unnecessary for the unfolding mechanisms to include an additional mechanism to compensate for the variation in vertical height of the gripping brackets relative to the top edge of the sides of the crate that would otherwise occur if the pivoting points of the unfolding mechanisms did not coincide with the pivot points 59, 60 of the sides 51, 52 of the crate 50.

Operationally, it is noted that once a crate 50 has been positioned in the unfolding area 106, the unfolding mechanism 121 must operate to move side 52 to an upright position before the unfolding mechanism 117 operates to move side 51 into an upright position. Such a progression is necessary since, in the folded condition, side 52 overlaps side 51 and thus renders side 51 inaccessible by the folding mechanism 117 until side 52 has been oriented in an upright position.

Figure 5D:
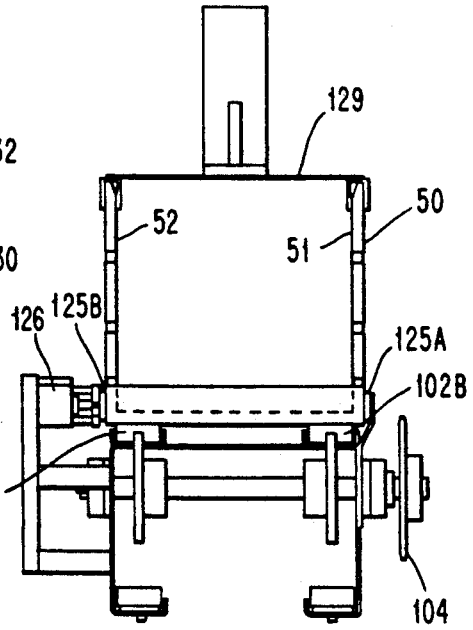
Figure 6:
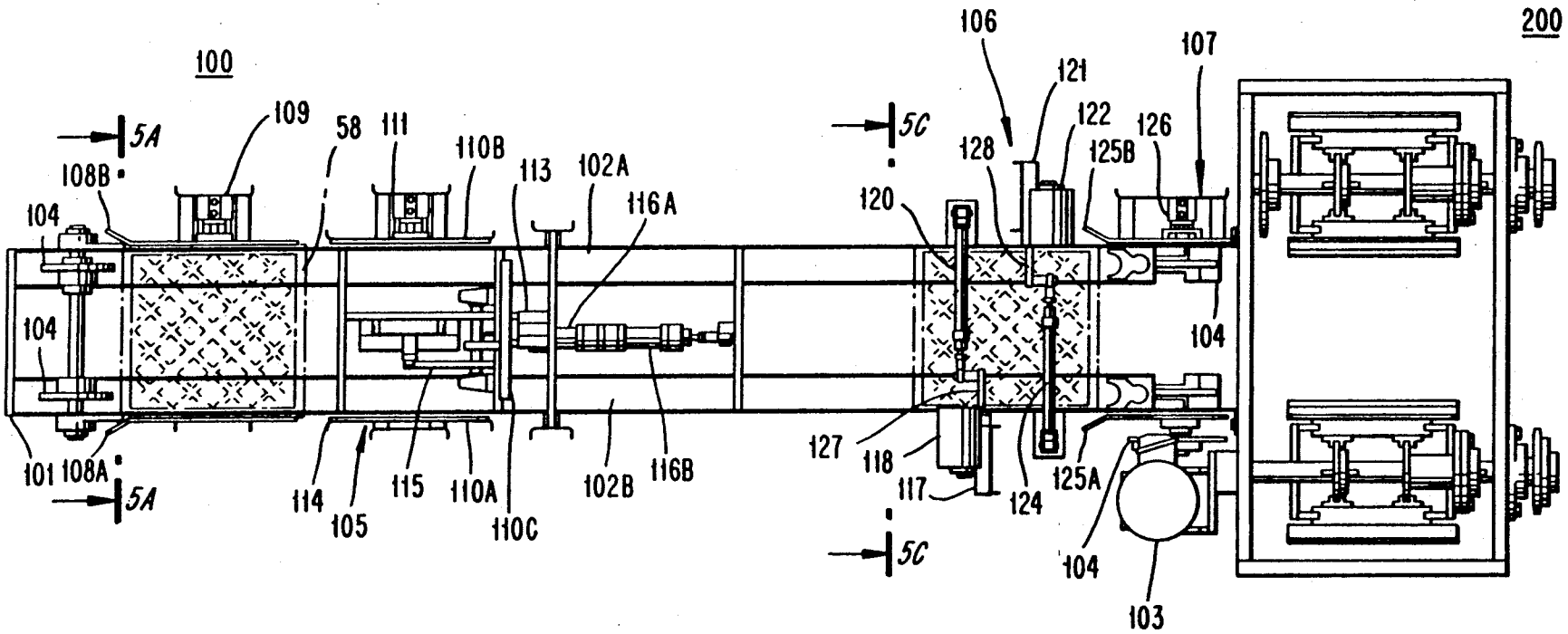
FIG. 6 is a top view of the unfolder of FIG. 5.

After a crate 50 has been oriented into an unfolded condition, conveyor tracks 102A, 102B along with back pressure provided by the crates upstream of the crate 50, then transport the unfolded crate 50 to the holding area 107 that is formed by the guard rails 125A, 125B. The guard rail 125A is fixed in a stationary manner on conveyor platform 101. Guard rail 125B, however, is movable by actuator 126 in a direction transverse to the conveying direction of the tracks 102A, 102B. After an unfolded crate 50 is moved to the holding area 107, the actuator 126 causes guard rail 125B to hold the crate against the stationary guard rail 125A. As shown in FIG. 5D, the upright sides 52, 51 of the crate 50 are maintained in an upright position by a guide plate 129. The unfolded crate 50 is maintained in the holding area 107 until it is desired to transport the unfolded crate to the lowerator 200.

Lowerator

Referring to FIGS. 7, 7A–7D and 8, the lowerator 200 is located adjacent the unfolder 100 and serves to first lower unfolded crates 50 into a loading position 210 adjacent the cross-pusher/loader and then to a banding location 211 where the contents of the loaded crate 50 are secured within the crate 50 by a polypropylene band. The lowerator includes a frame 201 upon which a pair of conveyor guides 202A, 202B are situated along the height of the frame 201. The conveyor guides 202A, 202B are each positioned on either side of an endless loop chain 204A, 204B respectively. Disposed upon each chain 204A, 204B with a plastic block are a series of crate guides 203 that slide along the conveyor guide 202A, 202B during movement of each chain 204A, 204B. The crate guides 203 are spaced along each chain 204A, 204B such that the guides 203 of chain 204A are always positioned directly opposite corresponding guides 203 on 204B. The guides 203 are also spaced in a manner to provide a bottom support and a top retention feature for each crate 50 that is transported by the lowerator.

Figure 7:
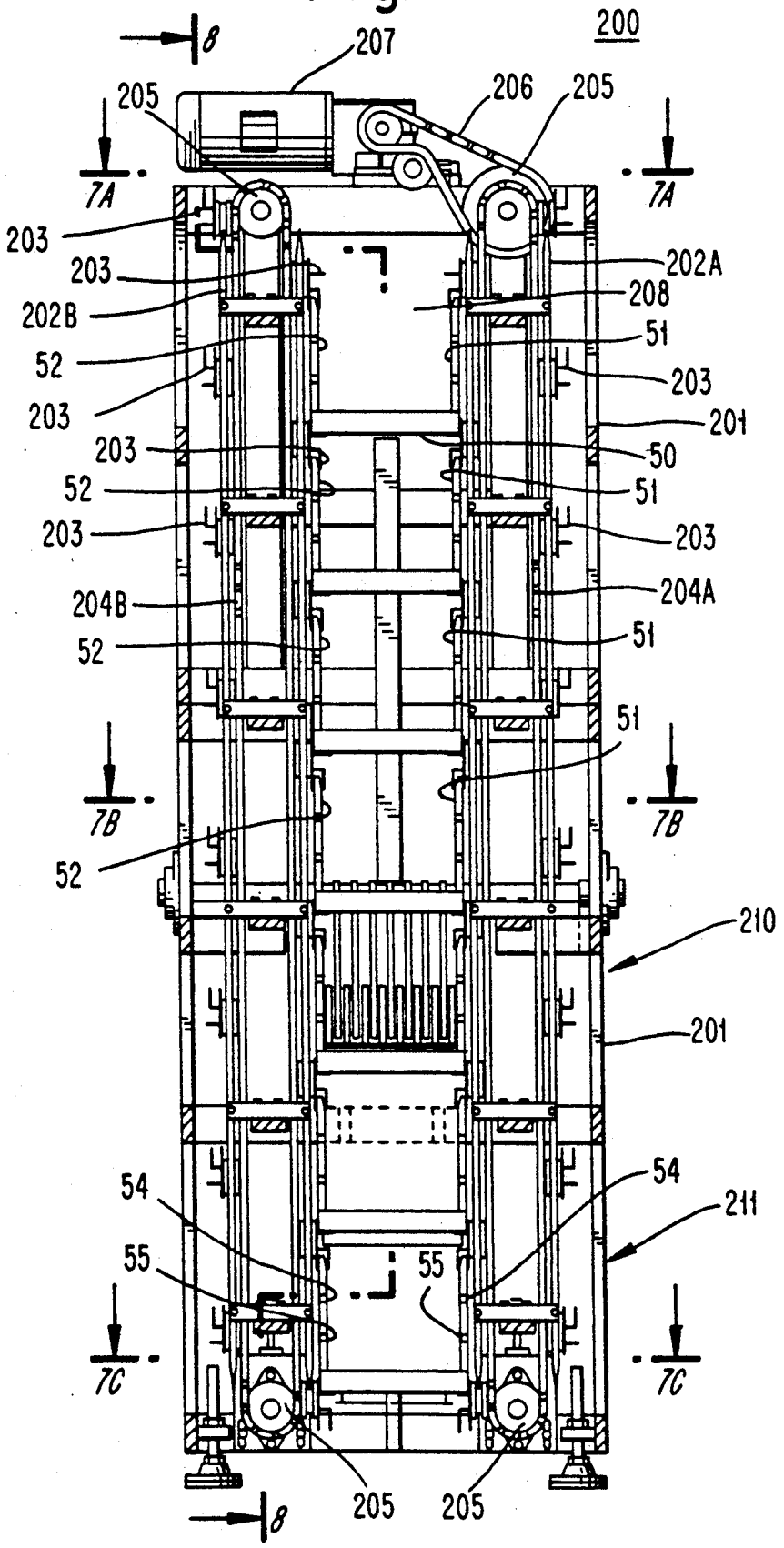
FIG. 7 is a cross-sectional view of the lowerator of the apparatus of FIG. 1.
Figure 7A:
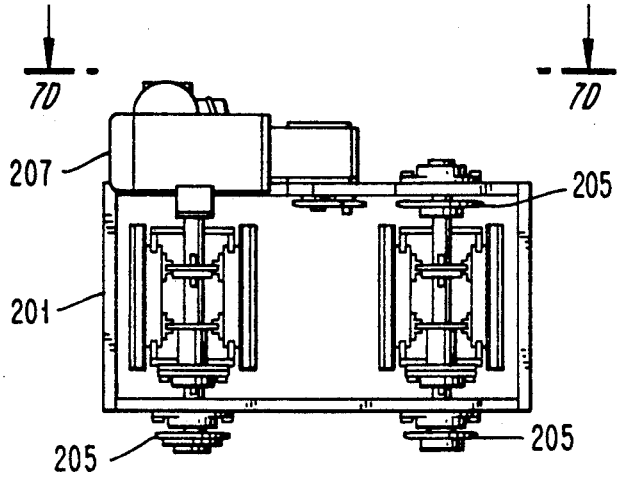
FIGS. 7A–7C are cross-sectional views of the lowerator of FIG. 7 along the lines 7A to 7C respectively in FIG. 7.
Figure 7B:
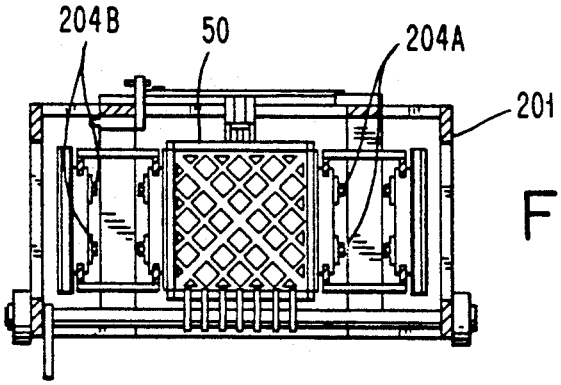
Figure 7C:
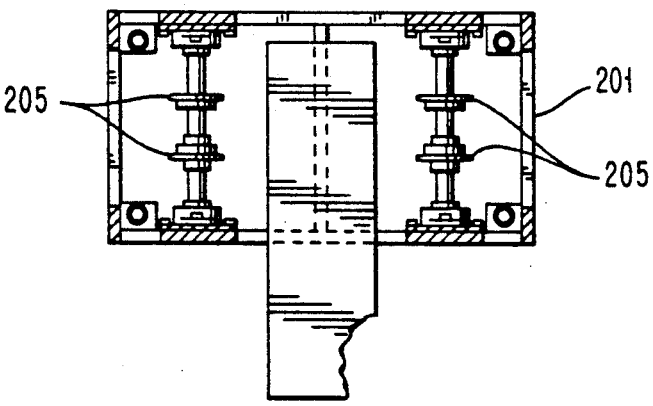
Figure 7D:
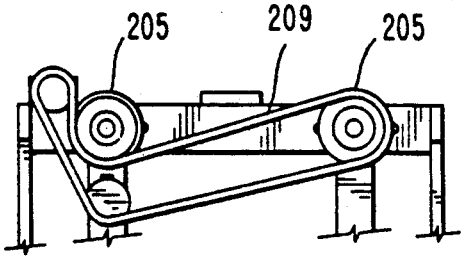
FIG. 7D is a top view of the cross-sectional view of FIG. 7C.
Figure 8:
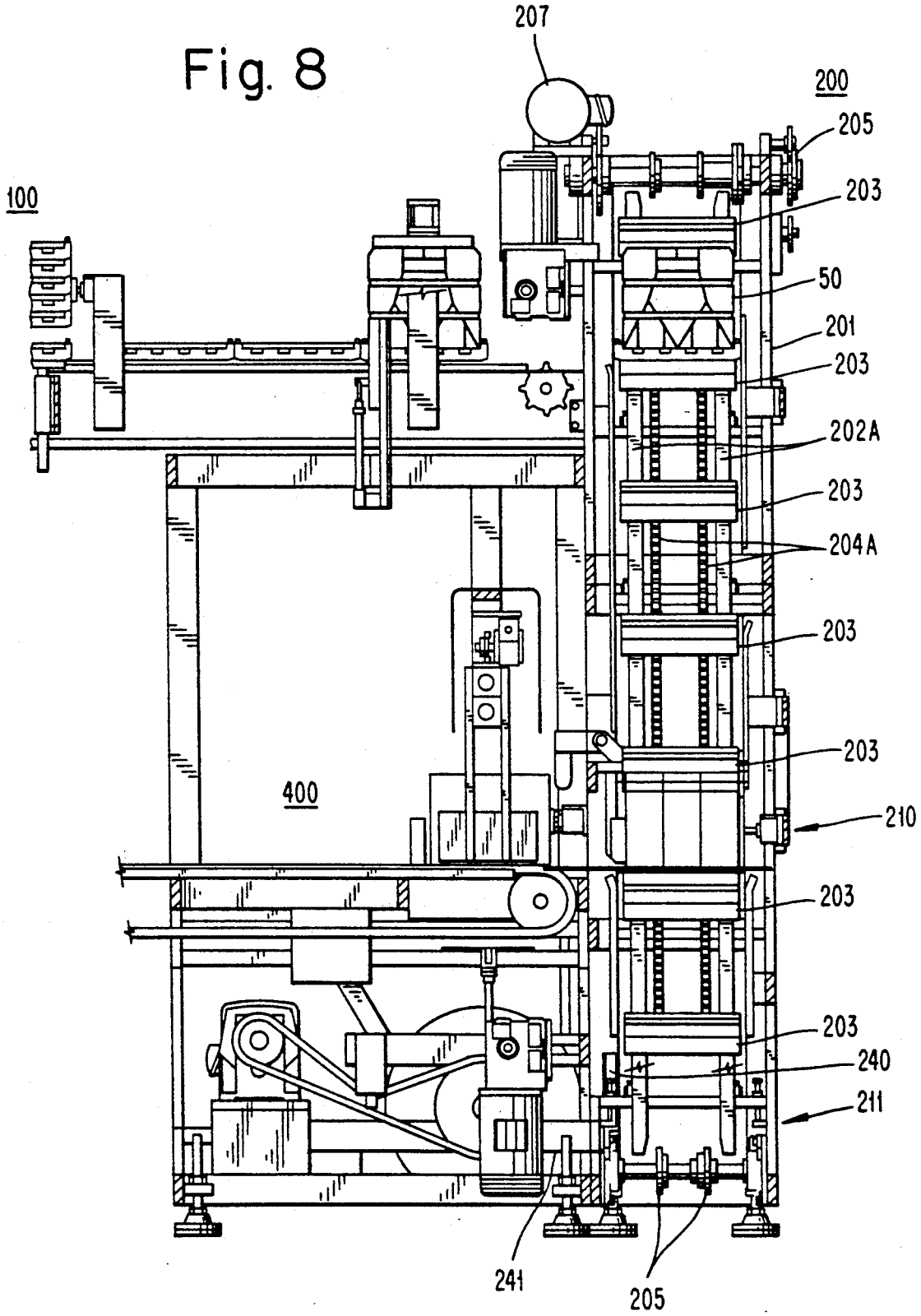
FIG. 8 is a side view, partially in cross-section, of the lowerator of FIG. 7.
Figure 9:
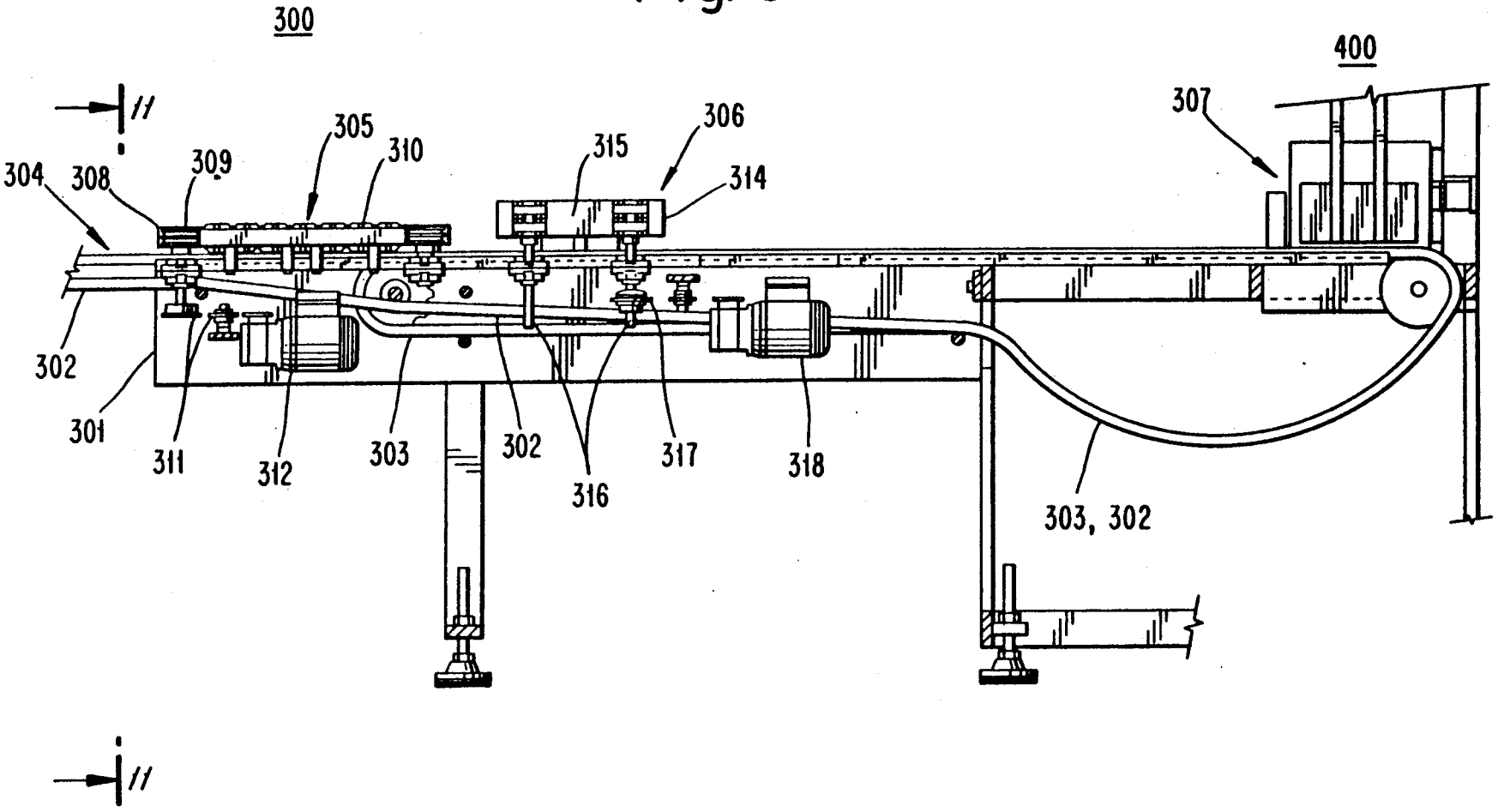
FIG. 9 is a side view, partially in cross-section, of the infeed of the apparatus of FIG. 1.

Each of the chains 204A, 204B are engaged around respective sprockets 205 that are located both at the top and the bottom of frame 201. The uppermost sprocket 205 of chain 204A is linked to a motor 207 through a driving chain 206. As shown in FIG. 7D, a linking chain 209 links the uppermost sprocket 205 for chain 204B to the uppermost sprocket 205 for chain 204A so that both chains 204A and 204B are driven by the same motor 207.

Following the unfolding of a crate 50 by the unfolder 100, the crate 50 enters the lowerator at entrance 208. The side 51 of crate 50 is retained by a crate guide 203 located on chain 204A and, similarly, a crate guide 203 on chain 204B retains side 52 of crate 50. The bottom of the crate 50 is also supported by guides 203 that are situated on both chains 204A and 204B. Each crate 50 that is transported into the lowerator 200 is then sequentially lowered to the loading area 210 which is located adjacent the cross-pusher/loader 400. After containers such as cartons are loaded into the crate 50 by the cross-pusher/loader 400, the loaded crate is lowered further to the banding area 211.

In the banding area 211, a bander 600 serves to surround the loaded crate with a polypropylene strip (not shown) that fits into either slot 54 or 55 of the crate 50. Depending on the size of the loaded contents in the crate and the desired stability of the filled crate 50, a polypropylene band may be secured on one or both of slots 54, 55. Following banding of the crate 50, the crate may be transported to the stacker 500 by a pusher 240 actuated by an actuator 241.

Infeed

Referring to FIGS. 9–14, the infeed 300 serves to transport containers such as cartons 56 from a carton filler (not shown) to the cross-pusher/loader 400 in an orderly fashion. The infeed 300 includes an infeed platform 301 having a braking area 305, a lane dividing area 306 and a holding area 307. Transporting the cartons 56 through each of these areas are two conveyor tracks 302, 303 that are mounted within the platform 301 and travel to the right. Conveyor track 302 extends the entire length of the platform 301 while conveyor track 303 extends only from the braking area 305 to the holding area 307. Each of the conveyor tracks 302, 303 are operated in an endless loop configuration and are driven by a motor (not shown). Between the braking area 305 and the lane dividing area 306, the conveyor tracks 302, 303 are situated to travel side by side. At the end of the lane dividing area 306, however, the conveyor track 303 diverges from the conveyor track 302 so that the tracks 302, 303 become separated in the holding area 307.

As the cartons 56 exit a filler (not shown) located upstream of the infeed 300, the conveyor track 302 transports the cartons 56 to the braking area 305. The cartons 56 are positioned on conveyor track 302 by the filler (not shown) in a random manner so the spacing between each carton 56 is likely to be irregular. However, at the braking area 305 the cartons are resituated on the conveyor track 302 so as to provide a consistent and accurate spacing along the progressing line of cartons 56. The correct spacing is necessary in order to enable the infeed to provide the proper number of cartons 56 to the lane divider 314 which is discussed subsequently.

The braking area 305 is bounded by a guard rail 313 and a braking device 308 along the entrance area 304 of the infeed 300. The guard rail 313 is fixed in a stationary manner to the infeed frame 301. The braking device 308 is also fixed to the frame 301 and includes a braking belt 309 wrapped around a pair of drive wheels 311 and a series of compression rollers 310. The belt 309 is caused to circulate around the wheels 311 and rollers 310 by a motor 312 at a speed that is slower than the transporting speed of the conveyor tracks 302, 303. The braking device 308 is positioned on the frame 301 such that the cartons 56 moving on the track 302 are compressed between the guard rail 313 and the belt 309 as supported by the rollers 310 when the cartons enter the braking area 305.

Since the belt 309 is caused to circulate at a speed less than the speed of the conveyor tracks 302, 303, the cartons 56 are slowed relative to the speed of the conveyor track 302 at the entrance to the braking area. Consequently, each carton 56 entering the braking area 305 is moved into contact with the carton located just before it thus eliminating any irregular spacing otherwise present between each carton 56 on the track 302.

When each carton 56 reaches the downstream end of the braking area 305, the carton 56 will be released from the belt 309 and guard rail 313 and the carton 56 will be transported to the lane dividing area 306 by the conveyor tracks 302, 303. As the cartons exit the braking area 305, however, each of the cartons 56 will be accelerated relative to the speed of the belt 309 by the conveyor tracks 302, 303 such that consistent and accurate spacing will result between each carton 56 that exits the braking area 305. The correct spacing of the cartons 56 enables a light activated counter to sense the number of cartons that are traveling to the lane dividing area 306. Other light-sensing devices are located along the infeed for further marshaling of the cartons to the cross-pusher/loader. Periodically, the belt 309 of the braking device will be stopped and cartons within the braking device will be prevented from movement so as to prevent the presence of an excessive number of cartons between the braking device and the cross-pusher/-loader.

During the infeed stage of the crate filling process, it will be desirable to periodically move a certain number of cartons 56 onto the second conveyor track 303. A predetermined number of cartons 56 must always periodically be present on both tracks 302, 303 in order to fill a crate 50 with the proper number of cartons 56. The specific number of cartons placed on either track 302, 303 at any particular time will depend on the number and size of cartons that are intended for loading into each crate. In order to provide the correct number of cartons 56 on track 303, an elliptical lane divider 314 is mounted on the frame 301 immediately downstream of the counter 323.

Figure 13:
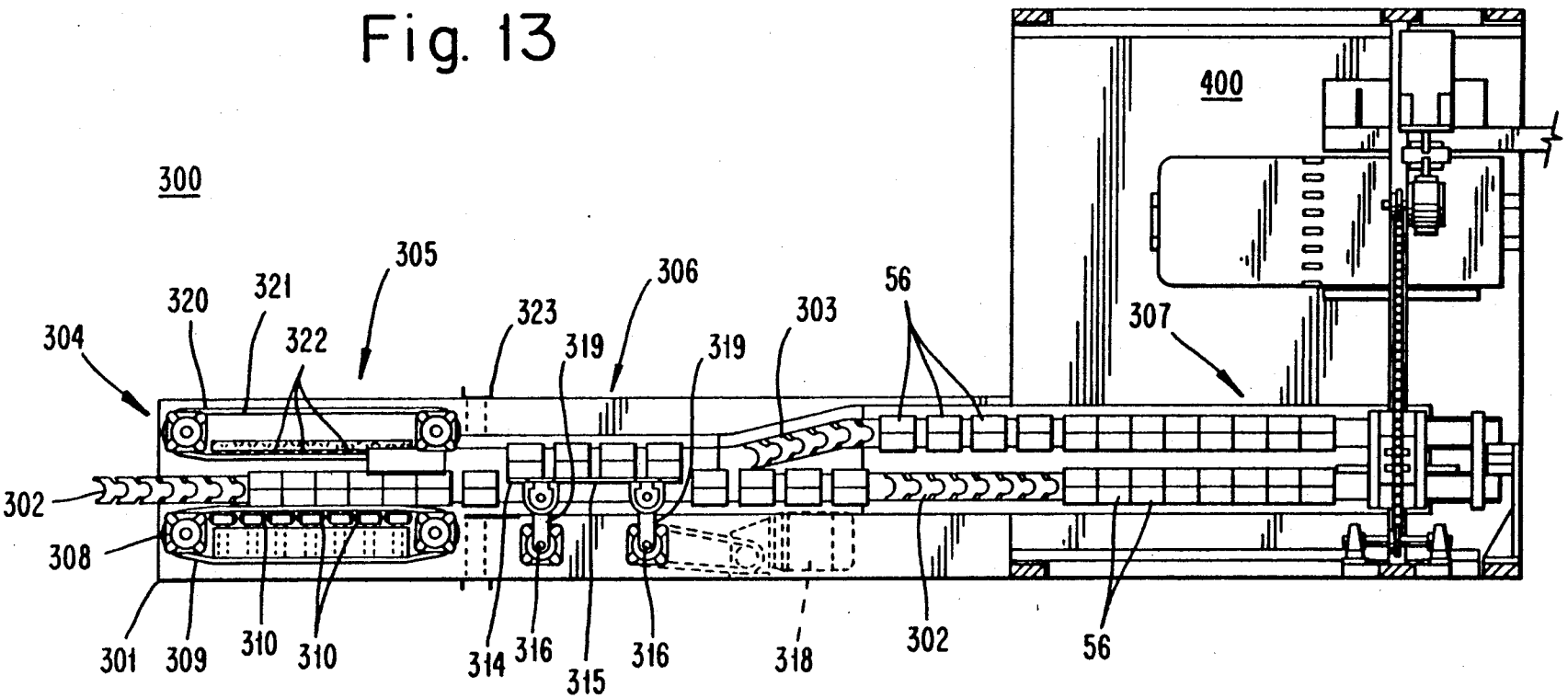
FIG. 13 is a top view of the infeed of FIG. 12.
Figure 14:
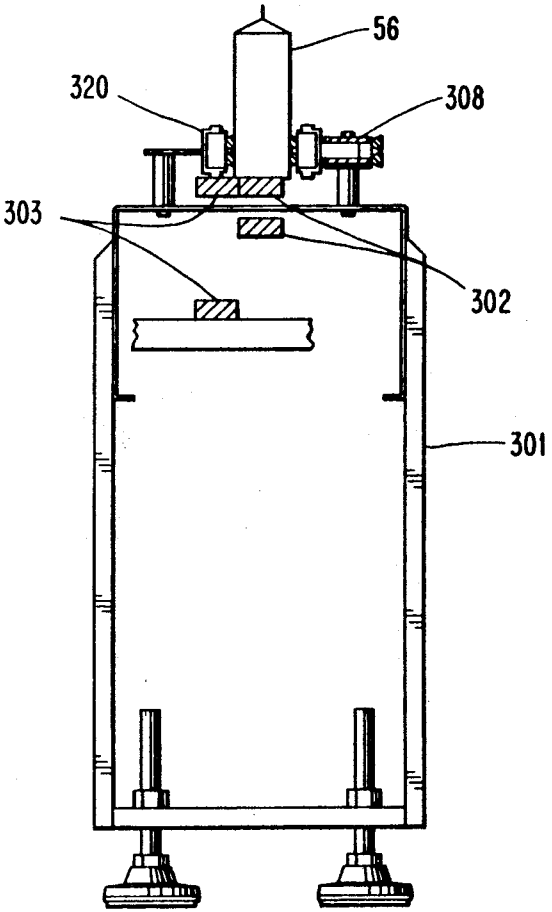
FIG. 14 is a cross-sectional view of the infeed in FIG. along the line 14—14.
Figure 11:
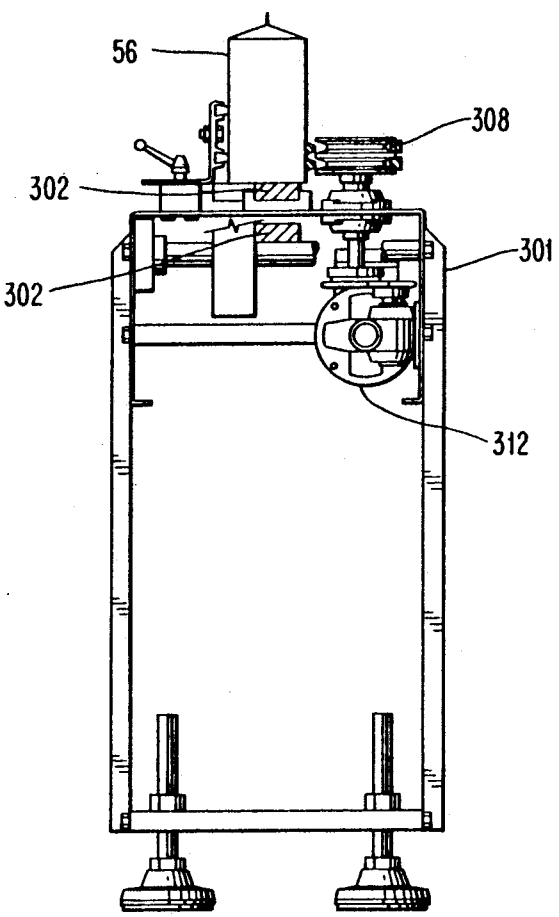
FIG. 11 is an end view of the infeed of FIG. 9.
Figure 16:
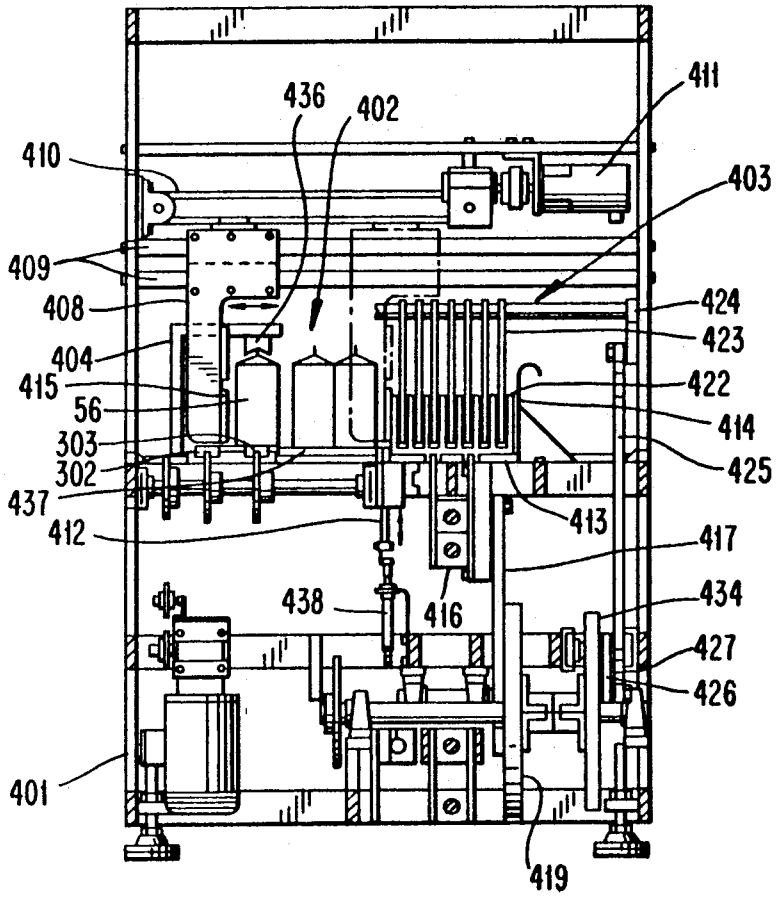
FIG. 16 is a an end view, partially in cross-section, of the cross-pusher/loader of FIG. 15.
Figure 15:
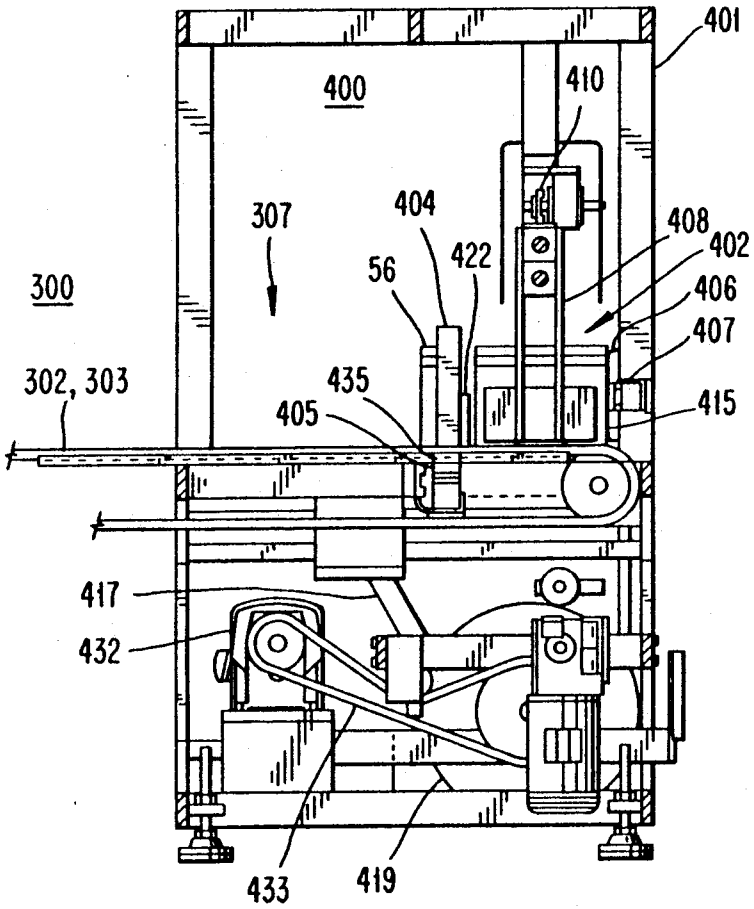
FIG. 15 is a front elevational view, partially in cross-section, of the cross-pusher/loader of the apparatus of FIG. 1.
Figure 19:
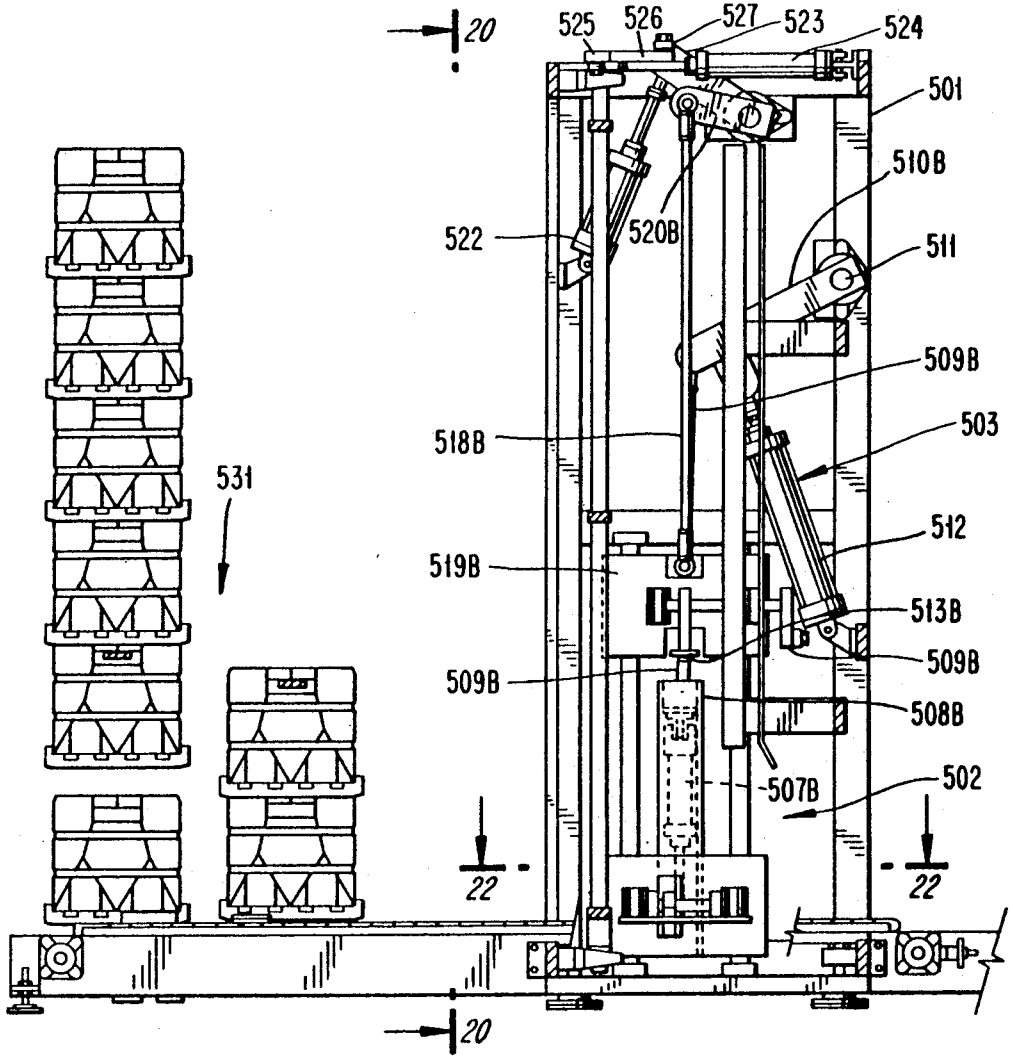
FIG. 19 is a front elevational view of the stacker of the apparatus of FIG. 1.
Figure 20:
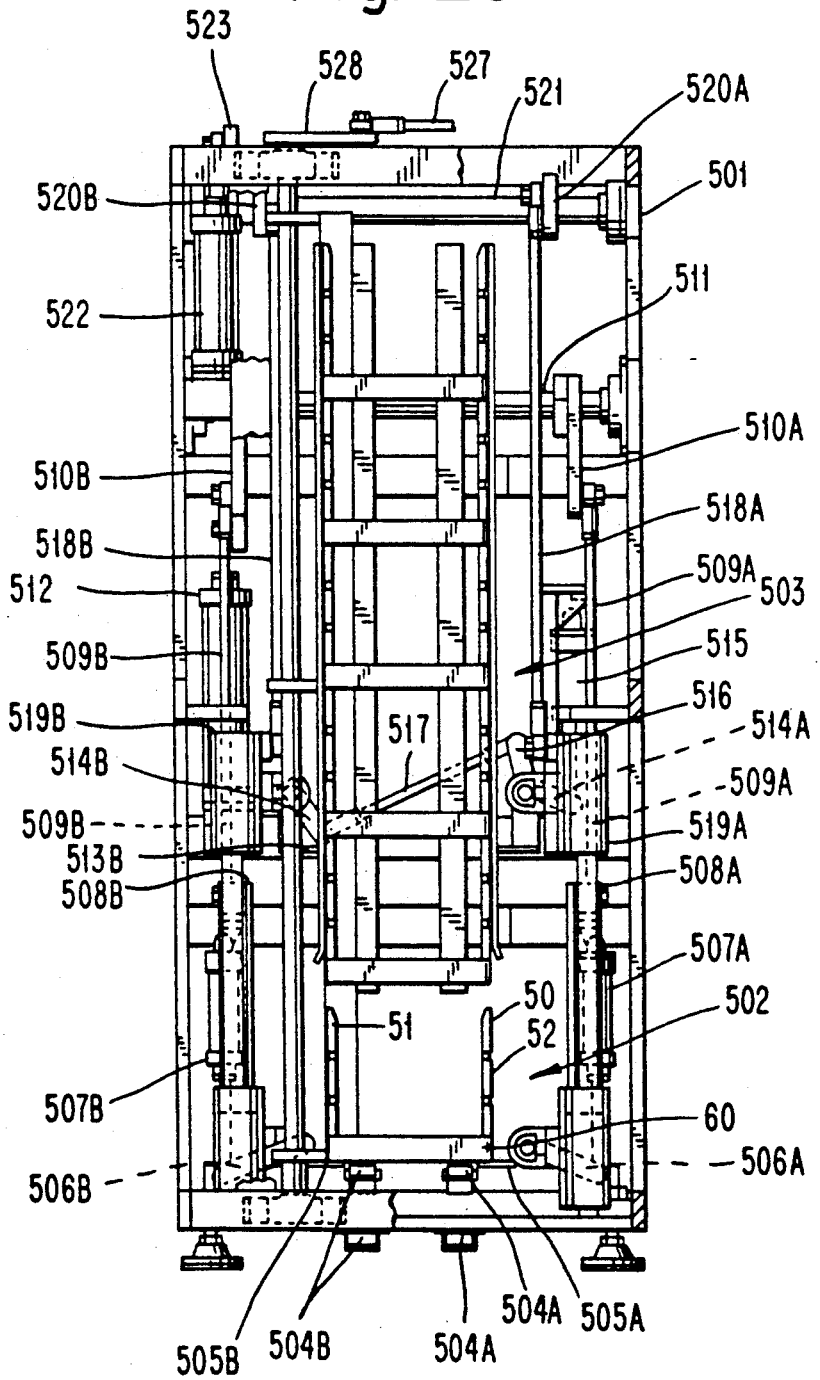
FIG. 20 is a cross-sectional view of the stacker along the line 20—20 in FIG. 19.
Figure 22:
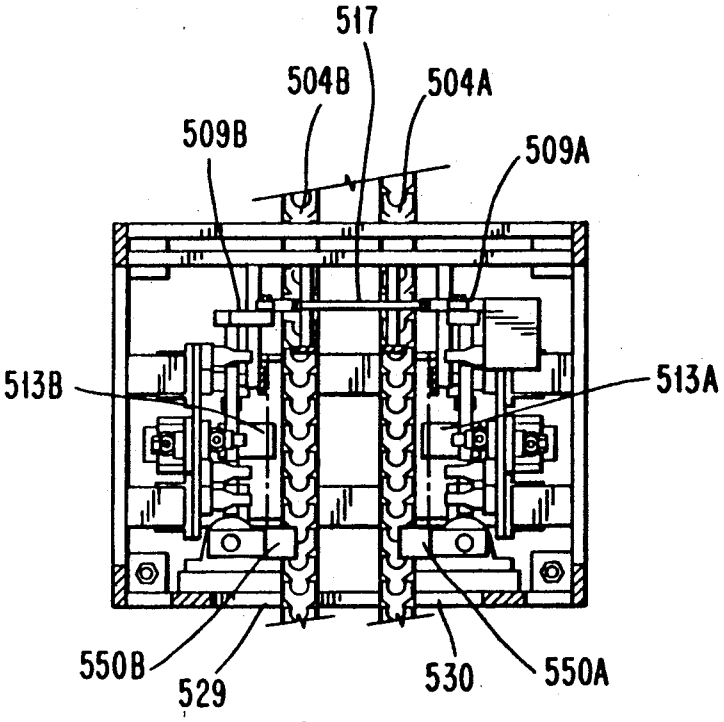
FIG. 22 is a cross-sectional view of the stacker of taken at lines 22 to 22 of FIG. 19.
Figure 21:
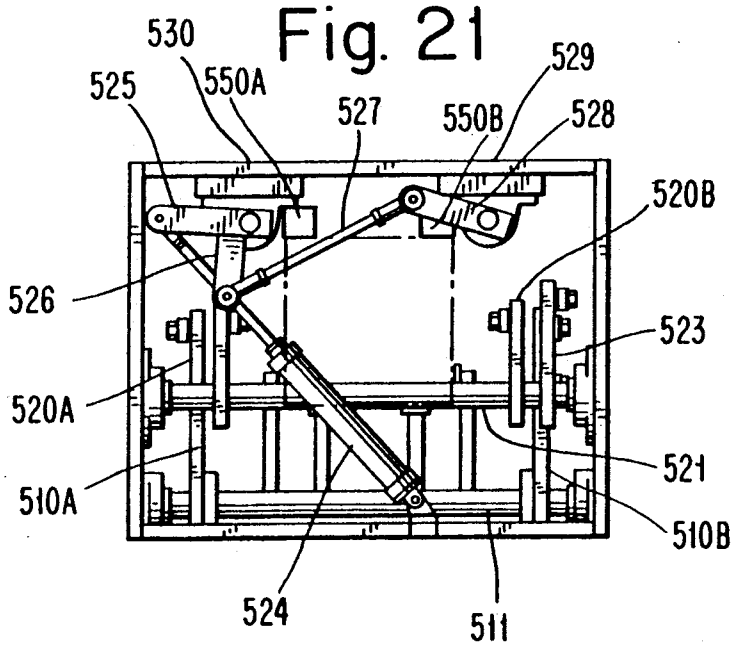
FIG. 21 is a top view of the stacker of FIG. 19.
Figure 23:
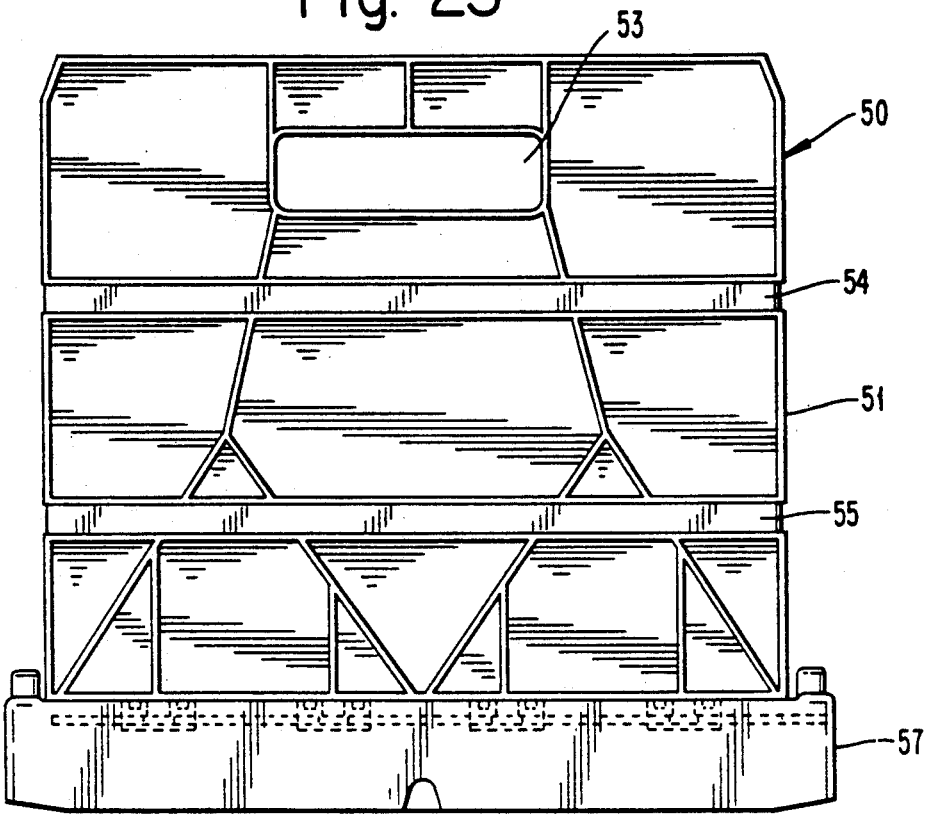
FIG. 23 is a side view of a crate used in the apparatus of FIG. 1.

The elliptical lane divider 314 includes a pusher plate 315 that is attached at two locations to driving arms 319. Each of the driving arms 319 are attached to shafts 316 that are driven by drive wheels 317. The drive wheels 317 are linked to each other by a chain (not shown) and are driven by a motor 318 by a second chain (not shown). When the motor 318 is energized, the driving arms 319 are caused to rotate by the shafts 316. The motion of the driving arms 319, in turn, imparts an elliptical motion to the pusher plate 315 such that the pusher plate 315 is extended to the second conveyor track 303 when the driving arms 319 are positioned transverse to the transporting direction as shown in FIG. 13. The motion of the pusher plate 315 across track 302 to track 303 will cause a desired number of cartons to slide off of track 302 and onto track 303.

The speed of the elliptical motion of the pusher plate 315 is selected such that the component of elliptical motion in the transport direction is equal to the speed of the conveyor tracks 302, 303. Consequently, when the cartons 56 that are selected for displacement from track 302 to track 303 are pushed, they are not subjected to differing motions in the transport direction that would otherwise disrupt the desired spacing or perhaps tip one or more of the cartons.

Figure 10:
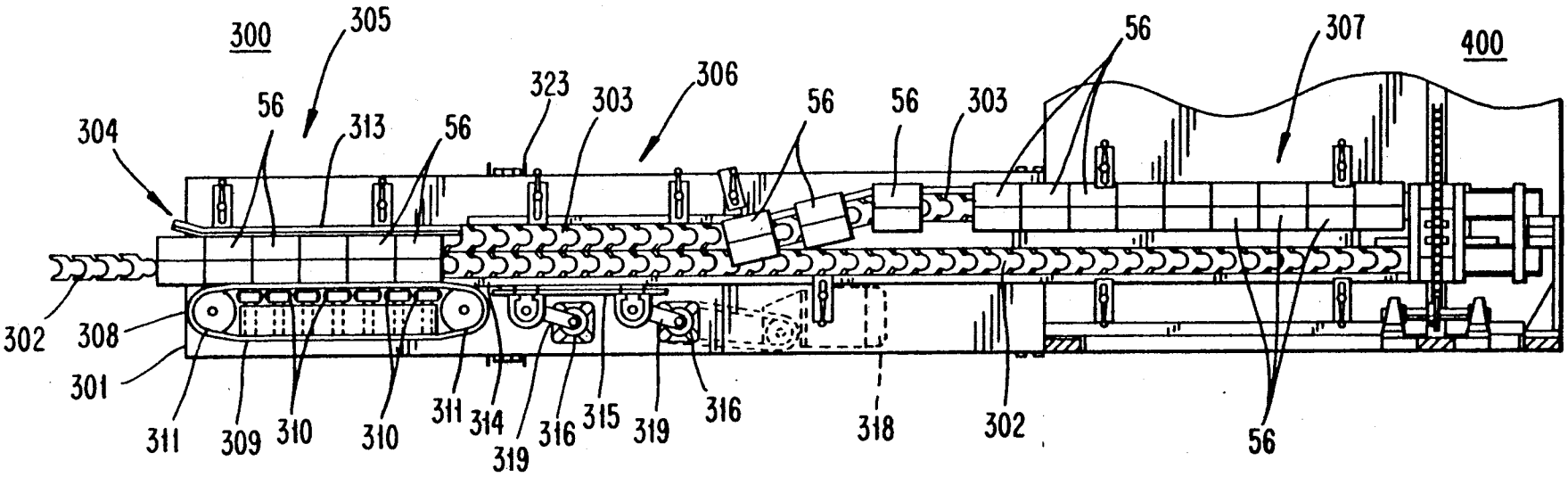
FIG. 10 is top view of the infeed of FIG. 9.
Figure 12:
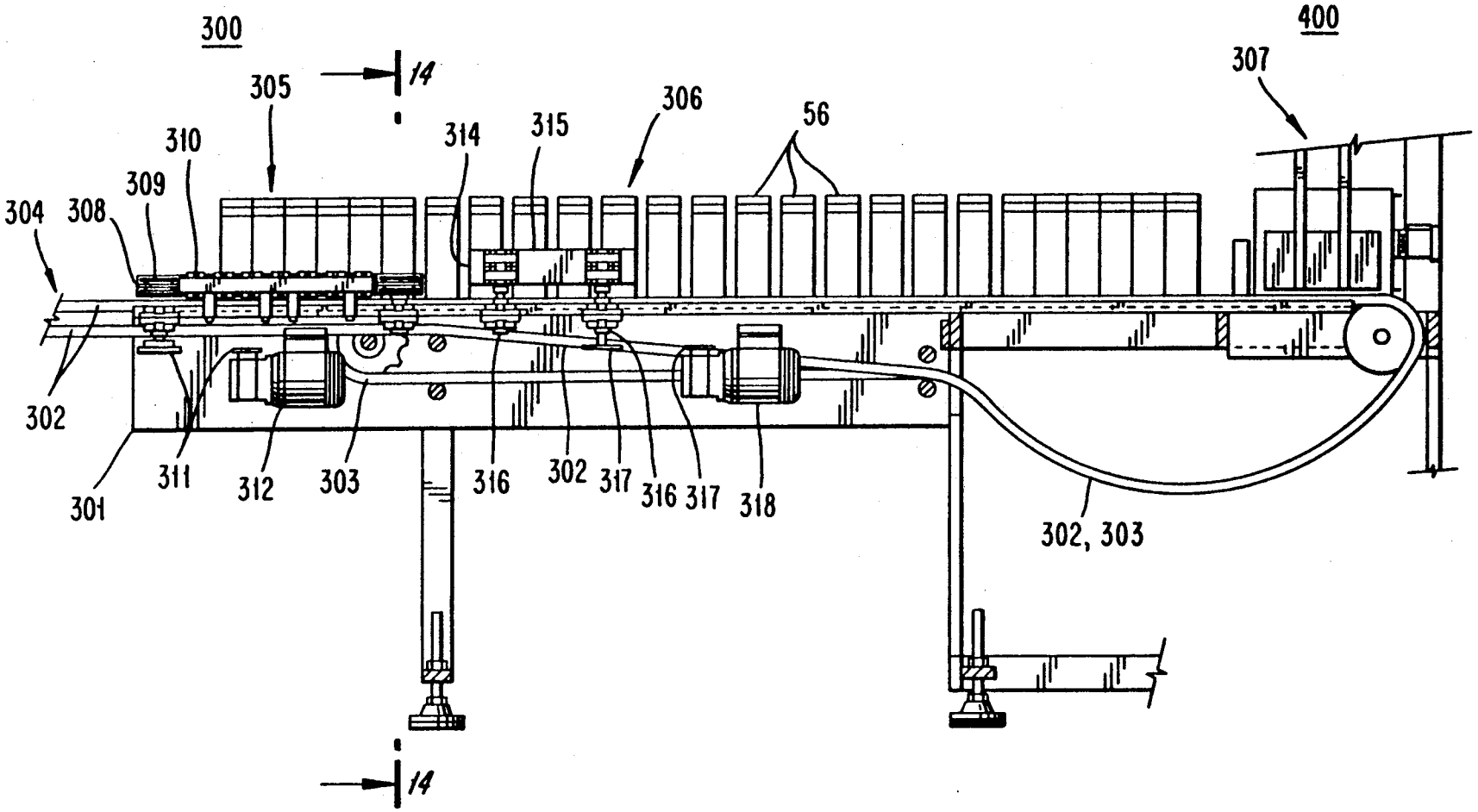
FIG. 12 is a side view, partially in cross-section, of a modified form of the infeed of the apparatus of FIG. 1.

Following the pushing of a desired number of cartons from track 302 to track 303, the pusher plate 315 of the elliptical lane divider 314 continues in an elliptical motion until the home position shown in FIG. 10 is reached. The cartons 56 that have been moved to conveyor track 303 are then transported to the holding area 307. Similarly, any cartons 56 that are not pushed from conveyor track 302 are also transported to the holding area 307. In the holding area 307 the desired number of cartons 56 are prepared for insertion into the crate 50 by the crate-pusher/loader 400.

In an additional preferred embodiment of an infeed 300 of the present invention, the guard rail 313 in the braking area 305 may be replaced with a second braking device 320 as shown in FIG. 13. The second braking device 320 includes a belt 321 and compression rollers 322 that are analogous to the belt 309 and rollers 310 of the first braking device 308. The use of two braking devices instead of a single braking device, will better ensure the proper braking of each of the cartons 56 that are received from the filler (not shown).

Cross-Pusher/Loader

The cross-pusher/loader 400 is depicted in FIGS. 15–18 and includes a frame 401 having a staging area 402 and a loading area 403. The staging area 402 is located adjacent the holding area 307 of the infeed 300 and serves as an area for arranging the proper number of cartons 56 for loading into a crate 50. The loading area 403 is located adjacent the staging area 402 and serves as an area from where a specified number of cartons 56 are inserted into a crate 50 that is positioned within the lowerator 200.

The cartons 56 are received into the staging area 402 from the holding area 307 of the infeed 300. Prior to receiving these cartons 56, however, a back plate 406 is positioned by an actuator 407 to extend into the staging area 402 in a direction opposite the transport direction of the tracks 302, 303. The containers 56 are transported into the staging area 402 until contact is made with the back plate 406 and the cartons are caused to be snugly positioned next to one another.

After a desired number of cartons 56 are located in the staging area 402 against the back plate 406, a holding device 404 is actuated on the carton or cartons 56 that are located immediately adjacent the staging area 402. These cartons will be the next cartons to enter the staging area. The holding device 404 restrains the carton or cartons 56 from any further movement by the conveyor tracks 302, 303 and includes a platform 435 that is actuated by an actuator 405. The actuator 405 urges the platform 435 upward from the platform 401 so as to lift the carton or cartons 56 adjacent the staging area 402 off of the conveyor tracks 302, 303 until the top of the cartons 56 are secured between the platform and holder receiving parts 436. Since the cartons adjacent the staging area are prevented from movement, all of the cartons 56 upstream of these cartons are prevented from movement as well and the spacing between cartons is eliminated.

Upon actuating the holding device 404 and preventing additional cartons 56 from entering the staging area 402, the actuator 407 is released and back plate 406 is urged in a direction out of the staging area 402. The cartons 56 that are now located in the staging area 402 are caused to follow the back plate 406 by the conveyor tracks 302, 303 until the cartons are centered within the staging area 402 and a space is present between the cartons located in the staging area 402 and the cartons held by the holding device 404.

The cartons 56 now being properly positioned within the staging area 402, a blocking plate 412 is urged upward by an actuator 438 to divide the staging area 402 from the loading area 403. A cross pusher 408 having a pusher plate 415 is then actuated and slides the cartons located in the staging area 402 off of the conveyor tracks 302, 303 and onto a staging area platform 437. The cartons 56 within the staging area 402 are urged onto the staging area platform 437 until the cartons come into contact with the dividing plate 412. The cross pusher 408 is moved along bar slides 409 by a chain 410 which is driven by a motor 411.

Following the transporting of the cartons 56 onto the staging area platform 437, the cross pusher 408 is returned to a home position and back plate 406 is again actuated by actuator 407 into the staging area 402. Holding device 404 releases the previously held cartons and additional cartons 56 are allowed into the staging area 402 due to the transporting movement of tracks 302, 303. The additional cartons are then transported into contact with the back plate 406, holding device 404 is again actuated to prevent further numbers of cartons from being transported and then backplate 406 is again retracted to produce a space between the cartons now present within the staging area 402 and those now held by the holding device 404.

The additional cartons 56 now being properly positioned within the holding area 402, the dividing plate 412 is lowered by the actuator 438 and the cross pusher 408 is again actuated along the slides 409. The additional cartons located on the transport tracks 302, 303 will be urged into contact with those cartons previously placed on the staging platform 437 and then all of the cartons located within the staging area 402 on platform 437 will be transported to the loading plate 413 situated in the loading area 403. The cartons 56 are prevented from extended movement within the loading area 403 by guide wall 414.

Following placement of the cartons 56 onto the loading area platform 413, the platform 413 is moved so as to locate the cartons 56 between the sides 51 and 52 of a carton 50 that is positioned adjacent the loading are 403 by the lowerator 200. Movement of the loading platform 413 is achieved by a camming mechanism that includes a wheel 419, a bar 417 and a block 416. One end of the bar 417 is connected to the block 416 in a vertical slide 418. The other end 421 of the bar 417 is located in a camming surface (not shown) of the wheel 419. The bar 417 is also attached to the frame 401 of the cross-pusher/loader at a rotate point 420. When the wheel 419 is caused to rotate by the motor 432 and belt 433, the end 421 of the bar 417 is caused to pivot about pivot point 420 from point 427 to point 429 by the camming surface (not shown) of the wheel 419. The pivoting motion of the bar 417 between points 427 and 429 causes the block 416 which is attached to the loading platform 413 to move in a reciprocal manner to and from the lowerator 200. During such movement, the slide 418 allows for vertical movement of the bar 417 within the block 416.

After the platform 413 having the cartons 56 has been position within the sides 51, 52 of the crate 50, a fingered arm 423 is lowered from a first position 438 to a second position 439 adjacent the cartons 56. The loading platform 413 is then retracted out of the crate 50 away from the lowerator 200 to its original position. The cartons 56, however, are prevented from returning with the platform 413 by the finger arm 423 and are thus deposited onto the bottom surface of the crate 50.

The finger arm 423 is caused to rotate around pivot point 424 from a first position 438 to a second position 439 by a mechanism including linking arm 425, bar 426 and a wheel 434. One end of the bar 426 is connected to the lower end of the linking rod 425. The other end of the bar 426 is fixed to the frame 401 at pivot point 427. A middle portion 440 of the bar 426 is disposed within a camming surface (not shown) of the wheel 434. When the wheel 434 is caused to rotate by motor 432, the bar 426 is caused to rotate around pivot point 427 between point 430 and point 431. The pivoting motion of the bar 426 causes upward and downward movement of the linking rod 425 that causes the finger arm 423 to pivot about pivot point 424. When the finger arm 423 is located in the second position 439 and the platform 413 is urged to its home position, a finger block 422 passes through the openings between the fingers on the finger arm 423. The finger block 422 otherwise serves to present any of the cartons from tipping during movement of the platform 413.

Following disposal of the cartons 56 into the crate 50 and movement of the platform 413 to the home position, a finger arm is rotated to its first position 438 and the cross-pusher/loader 400 is ready to load the next crate. Additional crates are loaded in an identical manner. It is appreciated that operation of the cross-pusher/loader will vary depending on the size and number of cartons intended for loading into a crate 50.

After a crate 50 has been loaded by the cross-pusher/-loader 400, the lowerator 200 causes the loaded crate 50 to descend to the banding area 211. A bander 600 then inserts a polypropylene strip around the carton 50 to secure the containers 56 therein. The loaded crate 50 is then in a condition acceptable for stacking by the stacker 500.

Stacker

The stacker is depicted in FIGS. 19–22 and includes a stacker frame 501 having an entrance and lifting area 502 and a holding area 503. A crate that has been filled by the cross-pusher/loader and banded in the lowerator 200 is raised in the entrance and lifting area 502 and then held in position within the holding area 503. As additional filled and banded crates 50 are raised from the entrance and lifting area 502, a stack of filled crates is formed in the holding area 503.

A loaded and banded crate 50 is transported from the lowerator 200 to the entrance and raising area 502 by conveyor tracks 504A, 504B until the crate 50 is stopped by blocks 550A, 550B. Support plates 505A, 505B, which are located on either side of the crate, are then positioned to engage the grooves 60 located on either side of the bottom surface of crate 50.

Each of the support plates 505A, 505B are rotated into a position to support the crate 50 by an actuator 507A, 507B, respectively. When each of the actuators 507A, 507B are extended, lever arms 506A, 506B cause the plates 505A, 505B to rotate into the engaging position beneath the crate 50. After the support plates 506A, 506B, have been properly positioned, the crate 50 is raised to the holding area 503 by actuator 512. The actuator 512 is attached at one end to the frame 501 and to a connecting arm 510B at the other end. Connecting arm 510B, in turn, is fixed to a shaft 511. Also attached to the shaft 511 is connecting arm 510A. Both connecting arms 510A and 510B are attached to connecting rods 509A, 509B, respectively, which, in turn, are connected to support members 508A, 508B, respectively. The support members 508A, 508B serve as support structure for each of the actuators 507A, 507B, respectively, thus, when the blocks 508A, 508B are raised by the connecting rods 509A, 509B, the entire structure including actuators 507A, 507B, lever arms 506A, 506B, support plates 505A, 505B and the crate 50 itself are also raised. The connecting rods 509A, 509B are caused to raise upwardly when the actuator 512 causes the lever arms 510A, 510B to rotate about shaft 511.

The crate 50 is raised from the raising area 502 to a position within the holding area 503 wherein holding arms 513A, 513B may engage the two handle openings 53 on each side 51, 52 of the crate 50 and thus hold the crate 50. Actuator 512 is then released and the structure containing the support plates 505A, 505B is allowed to return to the entrance and lifting area 502.

The holding arms 513A, 513B are caused to engage the handle openings 53 of the crate 50 through the actuation of actuator 515 which at one end is attached to a cross beam from connecting rod 518A. The other end of actuator 515 is connected to a lever arm 514A which, in turn, is connected to a holding arm 508A. The lever arm 514A is also attached to a connecting rod 517 which, in turn, is fixed to a lever arm 514B. The lever arm 514B is fixed to the holding arm 513B. When actuator 515 is extended, the rotation of lever arm 514A causes each of the holding arms 513A, 513B to engage the handle openings 53 of the crate.

After the support plates 505A, 505B have been returned to the home position within the entrance and lifting area 502, an additional crate is transported into the stacker 500 by the conveying tracks 504A, 504B. In the same manner as previously discussed, the support plates 505A, 505B engage the slots 60 on the bottom surface of the crate 50 and the crate is raised towards the holding area 503. Since a filled crate 50 is already present within the holding area 503, however, the additional crate 50 is raised only to a point wherein the sides 51, 52 of the additional crate 50 will engage the corresponding slots 60 within the crate 50 that has been previously raised.

When the sides 51, 52 of the additional crate 50 have been properly engaged in the slots 60 of the original crate 50 and both crates are supportable by the support arms 505A, 505B, the holding arms 513A, 513B will disengage from the handle openings 53 of the previously raised crate 50. Subsequently, the actuator 512 will continue to raise both crates 50 within the stacker 500 in the manner previously described until the lowermost crate 50 is in a position for the holding arms 513A, 513B to reengage into the handle openings 53 of the new lowermost crate. The structure containing the support arms 505A, 505B is then again lowered to the home position of the entrance and lifting area 502 of the stacker 500. This process is repeated until a stack of loaded crates 50 of a desired height is formed within the stacker 500.

When a desired number of loaded crates are stacked within the stacker 500 and the final crate 50 to complete the stack is located within the entrance and lifting area 502, the entire stack within the stacker 500 is gently lowered onto the final crate 50 through the actuation of actuator 522. The actuator 522 is connected to a lever arm 523 that is fixed to shaft 521. Also attached to shaft 521 are lever arms 520A, 520B which, in turn, are connected to connecting rods 518A, 518B, respectively. Each of the connecting rods 518A, 518B are connected to support blocks 519A, 519B, respectively. The support blocks 519a, 519b support the actuator 515 as well as the linkage for rotating the holding arms 513A, 513B. When the shaft 521 is caused to rotate by the actuator 522, lever arms 520A, 520B cause connecting rods 518A, 518B and, thus, the support blocks 519A, 519B to move in a downward direction. This movement causes the stack to be lowered onto the final crate 50 and then the arms 513A, 513B are released from the openings 53 of the crate 50. The arms 513A, 513B are then returned to the home position, above the entrance and lifting area 502 by the actuation of the actuator 522. The stack of loaded crates is now in a configuration acceptable for exit from the stacker.

In order for the stack to exit, the blocks 550A, 550B are rotated out of the conveyor path through the actuation of actuator 524. One end of actuator 524 is attached to a lever arm 525 which, in turn, is attached to block 550A. The lever arm 525 is also attached to a lever arm 526, which in turn, is connected to a connecting rod 527. The connecting rod 527 is attached to a lever arm 528 which, in turn, is fixed to the block 550B. When the actuator 524 is retracted, the motion imparted to the lever arm 525 causes each of the blocks 550A, 550B to swing open in an outward manner thus allowing the stack to exit the stacker through pivoting doors (not shown).

Upon successively lowering the stack of loaded crates onto the final crate 50, the blocks 550A, 550B are opened and the stack is transported to the exit platform 531 of the stacker 500 by the conveyor track 504A, 504B. The stack may then be moved for storage or vehicle loading as desired by the machine operator.

The packing machine of the present invention is operated according to preprogrammed logic of an electronic controller 700 which has an operating panel 701 located between the infeed 300 and the cross-pusher/loader 400. In addition to directing operations of each of the mechanisms within the packing machine, the electronic controller also serves to troubleshoot the packing machine through the use of various safety devices. For example, devices sensitive to light beams are positioned at certain locations throughout the packing machine to ensure the proper transporting of cartons 56 as well as the crates 50. If any of the safety devices positioned within the machine are tripped, the operation of the machine may be terminated or delayed until a machine operator can investigate any anomalies.

The form of the invention shown and described in the this disclosure represents a preferred embodiment. It is understood that various additional changes and variations are possible without departing from the spirit of the invention as defined in the claimed subject matter which follows.

What is claimed is:

1. An apparatus for loading crates comprising:

means for orienting a crate from a folded to an unfolded configuration, said means for orienting having first and second unfolding members for unfolding a first and second side of said crate wherein each of said first and second unfolding members are pivotable around a pivot axis of each of said first and second side of said crate, respectively;

means for loading an unfolded crate with packages;

means for transporting said unfolded crate from said means for orienting to said means for loading; and means for feeding said packages to said means for loading.

2. An apparatus as set forth in claim 1, wherein said means for orienting includes means for unstacking a stack of folded crates.

3. An apparatus for loading crates comprising:

means for orienting a crate from a folded to an unfolded configuration;

means for loading an unfolded crate with packages;

means for transporting said unfolded crate from said means for orienting to said means for loading, said means for transporting including means for lowering an unfolded crate to said means for loading; and means for feeding said packages to said means for loading.

4. An apparatus as set forth in claim 3, wherein said means for lowering includes a pair of conveyor tracks having guide members for supporting and guiding a crate during lowering.

5. An apparatus as set forth in claim 3, wherein said means for transporting includes guide means for maintaining said crate in an unfolded configuration.

6. An apparatus for loading crates comprising:

means for orienting a crate from a folded to an unfolded configuration;

means for loading an unfolded crate with packages;

means for transporting said unfolded crate from said means for orienting to said means for loading; and means for feeding said packages to said means for loading, said means for loading including holding means for periodically preventing said packages from entering said means for loading, said means for loading also including a holding platform for holding said packages against a receiving part.

7. An apparatus for loading crates comprising:

means for orienting a crate from a folded to an unfolded configuration;

means for loading an unfolded crate with packages;

means for transporting said unfolded crate from said means for orienting to said means for loading;

means for feeding said packages to said means for loading; and means for stacking loaded crates, said means for stacking including means for sequentially and repeatedly lifting and positioning said loaded crates beneath previously lifted crates so as to form a stack of loaded crates of a predetermined height, said means for sequentially and repeatedly lifting and positioning including support arms for supporting said loaded crates and holding arms for holding a lowermost crate of a stack being formed within said means for stacking.

8. An apparatus for loading crates comprising:
means for orienting a crate from a folded to an unfolded configuration;
means for loading an unfolded crate with packages;
means for transporting said unfolded crate from said means for orienting to said means for loading, said means for transporting including a banding means for securing said packages within said crate after loading; and
means for feeding said packages to said means for loading.

9. An apparatus as set forth in claim 8, wherein said banding means is located below said means for loading on said means for transporting.

10. An apparatus for loading crates comprising:
means for orienting a crate from a folded to an unfolded configuration;
means for loading an unfolded crate with packages;
means for transporting said unfolded crate from said means for orienting to said means for loading; and
means for feeding said packages to said means for loading, said means for feeding including a braking system for providing substantially equal spacing between each of said packages on said means for feeding.

11. An apparatus as set forth in claim 10, wherein said braking system includes a braking belt and a guard rail for restraining movement of each of said packages along said means for feeding.

12. An apparatus as set forth in claim 10, wherein said braking system includes a first braking belt and a second braking belt for restraining movement of each of said packages along said means for feeding.

13. An apparatus for loading crates comprising:
means for orienting a crate from a folded to an unfolded configuration;
means for loading an unfolded crate with packages;
means for transporting said unfolded crate from said means for orienting to said means for loading; and
means for feeding said packages to said means for loading, said means for feeding including a first and second lane for transporting said packages to said means for loading.

14. An apparatus as set forth in claim 13, wherein said means for feeding includes a lane divider for urging a predetermined number of packages from said first lane to said second lane during movement of said packages along said means for feeding.

15. An apparatus as set forth in claim 14, wherein said lane divider includes a pusher plate member that is rotatable in a elliptical motion.

16. An apparatus as set forth in claim 15, wherein said pusher plate member is adapted to rotate in an elliptical motion such that a lateral component of said elliptical motion is substantially equal in speed to a speed of transport of said packages on said means for feeding.

17. An apparatus as set forth in claim 13, wherein said means for feeding includes a braking system, a lane divider and a means for counting packages, said brake system located upstream of said lane divider, said means for counting packages disposed between said brake system and said lane divider.

18. An apparatus for stacking filled crates comprising:
means for sequentially lifting each of a plurality of crates such that a stack is formed with an upper crate supported by opposite sides of a lower crate engaging the upper crate;
means for holding said stack in an elevated position, said means for holding including a pair of holding arms pivotable to engage handle openings of sides of a lowermost crate of said stack so as to support said stack; and
means for lowering said stack to an unelevated position when a stack of a predetermined number of unfolded crates has been formed.

19. An apparatus for stacking filled crates according to claim 18, wherein said means for sequentially lifting comprises a pair of support members pivotable to engage opposite ends of a bottom surface of a crate intended for lifting, said means for sequentially lifting further comprising actuating means for vertically moving said pair of support members within said apparatus for stacking such that a crate intended for stacking may engage the bottom surface of a crate previously lifted.

20. An apparatus for stacking filled crates according to claim 18, wherein said means for lowering comprises an actuator means connected to said pair of holding arms for lowering said pair of holding arms such that said stack of a predetermined number of unfolded crates may be set upon a final crate to form a final stack.

21. An apparatus for stacking filled crates according to claim 20, further comprising conveying means for moving said final stack out of said apparatus for stacking through a pair of swinging doors, said doors automatically openable upon completion of the forming of said final stack.

22. An apparatus for stacking filled crates according to claim 19, wherein said pair of support members are engageable into grooves disposed along opposite ends of said bottom surface of a crate.

23. An apparatus for loading crates comprising:
means for orienting a crate from a folded to an unfolded configuration;
means for loading an unfolded crate with packages, said means for loading including a staging means for receiving packages from said means for feeding and a holding means for receiving said packages from said staging means, a cross-pusher urging said packages from said staging means to said holding means, said holding means including a movable platform for transporting said packages to said unfolded crate;
means for transporting said unfolded crate from said means for orienting to said means for loading; and
means for feeding said packages to said means for loading.

24. An apparatus as set forth in claim 23, wherein said holding area includes a movable finger arm for urging said packages from said movable platform onto said unfolded crate.

25. An apparatus as set forth in claim 24, wherein said movable platform and said movable finger arm are driven by a cam.

26. An apparatus for unfolding crates comprising:
means for unstacking a stack of folded crates, said means for unstacking including a movable unstacking platform for lowering a lowermost folded crate away from said stack onto a conveyor; and
means for orienting movable sides of each folded crate of said stack into an upright position, said means for orienting located downstream of said means for unstacking.

27. An apparatus for unfolding crates according to claim 26, further comprising means for maintaining said movable sides of said crate in an upright position.

28. An apparatus for unfolding crates according to claim 26, wherein said means for orienting includes first and second unfolding members for unfolding a first and second side of said crate.

29. An apparatus for unfolding crates according to claim 26, wherein said means for unstacking includes a movable stop plate for forming a space between two stacks of folded crates.

30. An apparatus for unfolding crates according to claim 28, wherein said first and second unfolding members include an arcuate section slidable in an arcuate slot to enable said pivoting of said first and second unfolding members 31. An apparatus for unfolding crates according to claim 28, wherein said first and second unfolding members are positioned to pivot around a pivot axis of said first and second side of said crate, respectively.

32. An apparatus for unfolding crates according to claim 31, wherein said first and second unfolding members each include a gripping bracket for engaging said first and second side of said crate, respectively.

33. An apparatus for loading packages into unfolded crates comprising:

a reaction station for receiving unfolded crates;

a filling station for filling said unfolded crates with packages;

a banding station for banding a filled crate; and means for transporting said unfolded crates in a vertical direction from said receiving station to said filling station and to said banding station.

34. An apparatus for loading packages into unfolded crates according to claim 33, wherein said means for transporting includes:

a pair of conveyors extending from said receiving station to said banding station; said pair of conveyors being spaced apart to receive a crate between them;

support means on each of said conveyors at corresponding vertical locations to maintain a crate in a substantially level position during movement in a vertical direction.

35. An apparatus for loading packages into unfolded crates according to claim 34, wherein each of said pair of conveyors includes at least one endless conveyor chain driven around a pair of conveyor chain wheels and said support means being spaced apart along each of said conveyor chains substantially the height of an unfolded crate and said support means including a flange for supporting a bottom edge of a crate and a slot for receiving a side of the next lower crate.

36. An apparatus for loading packages into unfolded crates according to claim 35, wherein each of said pair of conveyors further includes at least one slide bar for engaging each of said support means during the vertical movement of an unfolded crate, said at least one slide bar extending substantially the height of said apparatus such that each of said support means slides along said bar during vertical movement of an unfolded crate.

37. An apparatus for loading packages into unfolded crates according to claim 35, further comprising a means for banding a lowered crate disposed at said banding station, said means for banding including means for automatically wrapping a banding strip around said unfolded crate and a means for securing said banding material to said lowered crate.

38. An apparatus for loading packages into unfolded crates according to claim 35, further comprising pusher plate means for urging a banded crate out of said apparatus for loading, said pusher plate means disposed at said banding station.

39. An apparatus for loading packages into unfolded crates according to claim 35, wherein at least eight support means are fixed to each of said at least one endless conveyor tracks such that at least seven unfolded crates may be positioned within said apparatus for loading at one time.

40. An apparatus for loading packages into unfolded crates according to claim 35, wherein said flange and said slot provide support and guiding surfaces, respectively, that allow horizontal movement of an unfolded crate such that said unfolded crate may freely enter the apparatus for loading at the receiving station and may freely exit the apparatus for lowering at the banding station.

41. An apparatus for moving packages comprising:

holding area means;

braking area means;

a first conveyor means for supplying packages to said braking area means; said braking area means including means for restraining advance movement of packages relative to said first conveyor means and for releasing packages at predetermined intervals;

a second conveyor means, said first and second conveyor means extending from said braking area means to said holding area means; and lane divider means for periodically urging a predetermined number of packages from said first conveyor means to said second conveyor means whereby packages are accumulated at said holding area means.

42. An apparatus for moving packages according to claim 41, wherein said lane divider means includes a pusher plate member for pushing said packages, said pusher plate being rotatable in an elliptical motion.

43. An apparatus for moving packages according to claim 42, wherein said pusher plate member is rotatable in an elliptical motion such that a lateral component of said elliptical motion is substantially equal in speed to a conveying speed of said packages on said first and second conveyor means.

44. An apparatus for moving packages according to claim 41, further comprising means for counting a number of packages moving from said braking area means to said lane divider means such that a predetermined number of packages may be urged from said first conveyor means to said second conveyor means.

45. An apparatus for moving packages according to claim 41, wherein said braking area means includes a braking belt that urges packages against a guard rail such that a speed of transport of said packages is reduced relative to a conveying speed of said first conveyor means.

46. An apparatus for moving packages according to claim 45, wherein said braking belt rotates at a speed slower than said conveying speed of said first conveyor means so as to cause said packages to be in sliding contact with said first conveyor means.

47. An apparatus for moving packages according to claim 41, wherein said braking area means includes a first braking belt that urges packages against a second braking belt such that a speed of transport of said packages is reduced relative to a conveying speed of said first conveyor means.

48. An apparatus for moving packages according to claim 41, wherein said second conveyor means is positioned adjacent to said first conveyor means from said braking area means to said lane divider means and said second conveyor means is spaced apart from said first conveyor means starting from a location downstream of said lane divider to said holding area means.

49. An apparatus for moving packages according to claim 43, wherein said pusher plate member is connected to two drive arms that are rotatably fixed to said pusher plate member at opposed locations on a rear surface of said pusher plate member, said two drive arms being rotatable in a circular motion so as to provide said elliptical motion to said pusher plate member, at least one of said two drive arms being rotated by a motor.

50. An apparatus for inserting packages into an unfolded crate comprising:

a staging station for receiving packages from a feeder;

a loading station for collecting a predetermined number of packages from said staging station, said staging station positioned adjacent said loading station;

means for moving said packages from said staging station to said loading station;

means for transporting said packages from said loading station to an unfolded crate, said means for transporting comprising a platform for supporting said predetermined number of packages, said platform being reciprocably movable into and out of a region bounded by two sides of a foldable crate.

51. An apparatus for inserting packages according to claim 50, wherein said means for moving comprises a cross-pusher arm for pushing said predetermined number of packages to said loading station, said cross-pusher arm being reciprocably movable between said staging station and said loading station.

52. An apparatus for inserting packages according to claim 50, wherein said means for transporting further comprises a finger arm rotatably movable into a lowered position wherein said finger arms prevents said predetermined number of packages from moving with said platform when said platform is moving out of said region bounded by two sides of a foldable crate thus depositing said packages into said unfolded crate.

53. An apparatus for inserting packages according to claim 52, wherein said means for transporting further comprises a cam means for driving said platform in cooperation with said movable finger arm such that said finger arm is rotated to said lowered position after said platform is moved into said region bounded by two sides of a foldable crate and such that said finger arm is rotated out of said lowered position after said platform has been moved out of said region bounded by two sides of a foldable crate.

54. An apparatus for inserting packages according to claim 53, wherein said cam means includes a first cam connected to said platform and a second cam connected to said finger arm, said first and second cams mounted coaxially on a shaft and driven by a common motor.

55. An apparatus for inserting packages according to claim 52, wherein said platform includes a finger block vertically oriented on said platform to prevent said predetermined number of packages from tipping during movement of said platform, said finger block being formed of a plurality of posts equally spaced apart from each other along a width of said platform.

56. An apparatus for inserting packages according to claim 55, wherein said finger arm comprises a plurality of fingers spaced apart from each other such that said plurality of posts of said finger block pass between said fingers of said finger arm when said finger arm is in said lowered position and said platform is moved out of said region bounded by two sides of a foldable crate.

57. An apparatus for inserting packages according to claim 50, wherein said platform is positioned within said loading station.

58. An apparatus for inserting packages according to claim 50, wherein said staging station includes means for periodically preventing movement of packages from said feeder into said staging area, said means for periodically preventing movement being located at an entrance region to said staging station.

59. An apparatus for inserting packages according to claim 58, wherein said means for periodically preventing movement includes a pressure plate and a receiving member, said pressure plate being vertically movable so as to urge a package out of contact with a conveyor lane of said feeder and into engagement with said receiving member and thus prevent said package and any packages positioned on said conveyor lane upstream of said package from entering said staging station.

60. A method of loading packages into an unfolded crate comprising the steps of:

orienting each of two foldable sides of a folded crate into an upright position;

positioning said crate into a loading position;

inserting a predetermined number of packages between the upright sides of said crate;

banding said crate to secure said packages within said crate; and positioning said crate beneath a previously loaded crate to form a stack of loaded crates of a predetermined height.

61. A method of loading packages into an unfolded crate according to claim 60, wherein prior to said step of orienting each of two foldable sides of a folded crate into an upright position, said folded crate is removed from a stack of folded crates.

62. A method of loading packages into an unfolded crate according to claim 60, wherein after said step of inserting a predetermined number of packages between the upright sides of said crate, said crate is moved vertically to a banding station.

63. A method of loading packages into an unfolded crate according to claim 60, wherein said step of inserting a predetermined number of packages between the upright sides of said crate includes moving a platform supporting said predetermined number of packages to a location between the upright sides of said crate.

64. A method of loading packages into an unfolded crate according to claim 63, wherein said step of inserting a predetermined number of packages between the upright sides of said crate further includes moving a finger arm into a position adjacent said predetermined number of packages such that said finger arm causes said predetermined number of packages to be deposited onto a bottom surface of said crate when said platform moves out of said location between the upright sides of said crate.

65. A method of loading packages into an unfolded crate according to claim 64, wherein movement of said finger arm is timed relative to movement of said platform.

66. A method of loading packages into an unfolded crate according to claim 63, wherein prior to inserting a predetermined number of packages between the upright sides of said crate, a means for staging receives packages from a feeder and moves said packages onto said platform until said predetermined number of packages is positioned on said platform.

67. A method of loading packages into an unfolded crate according to claim 66, wherein said means for staging repeatedly moves an initial number of packages unto said platform until a predetermined number of packages is placed on said platform.

68. A method of loading packages into an unfolded crate according to claim 60, wherein said step or orienting each of two foldable sides of a folded crate into an upright position includes moving first and second pivot arms to engage each of said two foldable sides, respectively, and to pivot said first and second pivot arms around a pivot axis of each of said two foldable sides.

69. A method of loading packages into an unfolded crate according to claim 60, wherein said step of orienting each of said two foldable sides of a folded crate into an upright position occurs at an unfolding station and said step of inserting a predetermined number of packages between said upright sides of said crate occurs at a loading station and said step of banding said crate to secure said packages within said crate occurs at a banding station, wherein said unfolding station, said loading station and said banding station are each in vertical alignment relative to each other and wherein said crate is progressively vertically moved from said unfolding station to said loading station to said banding station by a means for vertically moving said crate.

70. A method of loading packages into an unfolded crate according to claim 60, wherein prior to said step of positioning said crate beneath a previously loaded crate to form a stack of loaded crates, a means for conveying moves said crate from a banding station to a means for stacking.

71. A method of loading packages into an unfolded crate according to claim 70, wherein said step of positioning said crate beneath a previously loaded crate to form a stack of loaded crates including moving a means for lifting so as to lift said crate such that top edges of each side of said crate engage grooves of said previously loaded crate and wherein after said step of positioning said crate beneath a previously loaded crate to form a stack of loaded crates, said means for stacking holds said stack until said stack is comprised of a predetermined number of crates and then lowers said stack onto a last crate to form a final stack.

72. A method of loading packages into an unfolded crate according to claim 60, including the step of moving said stack horizontally whereby said stack may be conveniently removed as a unit.

* * * * *